US007897542B2

(12) United States Patent
Oguma et al.

(10) Patent No.: US 7,897,542 B2
(45) Date of Patent: Mar. 1, 2011

(54) HEAT-SENSITIVE TRANSFER IMAGE-RECEIVING SHEET AND METHOD OF PRODUCING THE SAME

(75) Inventors: Kazuaki Oguma, Minami-ashigara (JP); Takuya Arai, Minami-ashigara (JP); Yoshihisa Tsukada, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 787 days.

(21) Appl. No.: 11/863,692

(22) Filed: Sep. 28, 2007

(65) Prior Publication Data

US 2008/0090727 A1 Apr. 17, 2008

(30) Foreign Application Priority Data

Sep. 29, 2006 (JP) ..... 2006-269766

(51) Int. Cl.
*B41M 5/035* (2006.01)
*B41M 5/42* (2006.01)
*B41M 5/50* (2006.01)

(52) U.S. Cl. ..... 503/227; 427/152; 428/32.39

(58) Field of Classification Search ..... None
See application file for complete search history.

(56) References Cited

U.S. PATENT DOCUMENTS 5,106,818 A 4/1992 Ashida
5,948,729 A 9/1999 Landry-Coltrain et al.

FOREIGN PATENT DOCUMENTS

| | | |
|---|---|---|
| JP | 2286290 | 11/1990 |
| JP | 2572769 | 10/1996 |
| JP | 11-321139 | 11/1999 |
| JP | 2005-43475 A | 2/2005 |
| JP | 2005-238748 | 9/2005 |
| JP | 2006-88691 A | 4/2006 |
| JP | 2006-240182 A | 9/2006 |

*Primary Examiner*—Bruce H Hess
(74) *Attorney, Agent, or Firm*—Sughrue Mion, PLLC

(57) ABSTRACT

A heat-sensitive transfer image-receiving sheet, which has a substrate, and a dye receptor layer provided at least one side of the substrate, wherein the heat-sensitive transfer image-receiving sheet contains at least one compound represented by formula (L1):

Formula (L1)

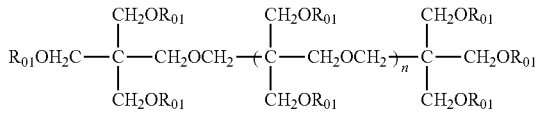

wherein $R_{01}$ represents —C(═O)R or a hydrogen atom, in which R represents an aliphatic group which may have a substituent, and a plurality of $R_{01}$'s are the same as or different from each other, but at least one of $R_{01}$'s is —C(═O)R, and n represents 0 or 1; and a method of producing the heat-sensitive transfer image-receiving sheet.

10 Claims, No Drawings

HEAT-SENSITIVE TRANSFER IMAGE-RECEIVING SHEET AND METHOD OF PRODUCING THE SAME

FIELD OF THE INVENTION

The present invention relates to a heat-sensitive transfer image-receiving sheet and a method of producing the same. Especially, the present invention relates to a heat-sensitive transfer image-receiving sheet capable of providing an excellent image with a high density, less in image defect, by a rapid processing; and to a method of producing the same.

BACKGROUND OF THE INVENTION

Various heat transfer recording methods have been known so far. Among these methods, dye diffusion transfer recording system attracts attention as a process that can produce a color hard copy having an image quality closest to that of silver halide photography (see, for example, "Joho Kiroku (Hard Copy) to Sono Zairyo no Shintenkai (Information Recording (Hard Copy) and New Development of Recording Materials)" published by Toray Research Center Inc., 1993, pp. 241-285; and "Printer Zairyo no Kaihatsu (Development of Printer Materials)" published by CMC Publishing Co., Ltd., 1995, p. 180). Moreover, the dye diffusion transfer recording system has the following advantages over silver halide photography: that is, the system is a dry system, it enables direct visualization from digital data, it makes reproduction simple, and the like.

In this dye diffusion transfer recording system, a heat-sensitive transfer sheet (hereinafter also referred to as an ink sheet) containing a dye(s) is superposed on a heat-sensitive transfer image-receiving sheet (hereinafter also referred to as an image-receiving sheet), and then the ink sheet is heated by a thermal head whose exothermic action is controlled by electric signals, in order to transfer the dye(s) contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

With the spread of such the dye diffusion transfer recording system, a speeding up of the print speed has been progressing. Consequently, such a problem has arisen that even though thermal energy of a conventional level is applied to both a conventional ink sheet and a conventional image-receiving sheet for printing, it is difficult to obtain a sufficient color density developed. This problem has been improved, for example, by a method of increasing thermal energy at the time of printing, or by a method of making a substrate sheet of the ink sheet into a thin-film to increase efficiency of heat transfer. These actions for increasing thermal energy to be applied to the image-receiving sheet at the time of printing necessitate the image-receiving sheet to have both a responsibility to a low thermal energy at the low density portion and a responsibility to a high thermal energy at the high density portion. Ordinarily, by a method of employing a thermoplastic polymer as a receptor polymer of the image-receiving sheet and also controlling a glass transition temperature (Tg) of the polymer, it has been accomplished to attain both the dye transferring property (generally the lower the Tg is, the higher the transferring property is) and the releasing property (releasability) of the image-receiving sheet from the ink sheet (generally the higher the Tg is, the less the problem of heat seal causes).

Under the above-mentioned measures, it is difficult to attain both the dye transferring property and the releasing property from the ink sheet, in a wide range of temperature. Besides, in a recent dye diffusion transfer recording system, for the purposes of protecting a surface of the image and improving fastness property of the image, a system of laminating the surface of the image with a protective layer has been becoming the mainstream. Consequently, it is also necessary to take care of transferring property of the protective layer to the heat-sensitive transfer image-receiving sheet. The transfer temperature of the protective layer is generally set lower than the dye transfer temperature (at least lower than a temperature necessary to achieve the maximum density), for prevention from thermal diffusion of the image. As a result, there is such a tendency that as the releasing property of the image-receiving sheet from the ink sheet becomes more favorable, transfer of the protective layer to the image-receiving sheet becomes more difficult.

The "'favorable' releasing property (of the image-receiving sheet) from the ink sheet" herein used means that any troubles that are called "sticking", such as generation of peeling noise, failure in traveling (or conveying) of the sheet, and/or occurrence of peeled line in the image, do not occur in the image-receiving sheet. Usually the sticking occurs in the image-receiving sheet, upon when an ink ribbon adheres to the surface of a receptor layer with its binder resin in a printing step, and after the printing, the ink ribbon is stripped off from the image-receptor layer, to cause sticking. If such the sticking occurs, not only a quality of the print image deteriorates, but also especially in the case of a serious sticking, a binder resin of the ink sheet adheres to the above-described surface of a receptor layer. As a result, in the case where an ink ribbon has failed to strip off from both a substrate of the ink ribbon and the surface of the receptor layer, it is in some cases caused such a trouble that an image-receiving sheet is pulled by the resultant ink ribbon, so that the image-receiving sheet is blocked or clogged in a printer without being delivered out from the printer, or a trouble that even though the image-receiving sheet is delivered out from the printer, the ink ribbon is broken.

For resolving these problems, a method of introducing a releasing agent into a surface of the image-receiving sheet has been proposed. Japanese Patents No. 2572769 and No. 2854319 describe releasing agents, such as polyethylene wax, amide wax, and Teflon (registered trade mark) powder, each of which is to be added to a receptor layer of the heat-sensitive transfer image-receiving sheet, and also disclose inventions to enhance releasing property from the ink sheet. However, these patents are silent in disclosure of measures to attain both transferring property of the dye and transferring property of the protective layer.

JP-A-11-321139 ("JP-A" means unexamined published Japanese patent application) describes a method of introducing a carnauba wax into a receptor layer composed of a certain polyester compound. This publication also describes that introduction of the carnauba wax enables to effectively prevent sticking from being occurred and also to improve releasing property from the ink sheet.

JP-A-2005-238748 describes a method of introducing a urethane-modified wax into the image-receiving sheet, thereby to attain both enhancement of transfer density and releasing property from the ink sheet. Still, this publication is silent in a method of attaining both any of the above-described properties and transferring property of the protective layer.

In the image-receiving sheets as described in these patent publications, however, even though it could have been accomplished in some degree to attain both transferring property of the dye and releasing property from the ink sheet, and further transferring property of the protective layer by regulating addition amounts, achievement of compatibility has not yet reached to a revel enough to be satisfied.

In order to dissolve the above-described problems, it is necessary to develop a technique by which a releasing agent effectively works owing to function of a high thermal energy at a high density portion, thereby to attain both the aforementioned releasing property and the transferring property of the protective layer according to a low thermal energy applied at the time of transfer of the protective layer.

SUMMARY OF THE INVENTION

The present invention resides in a heat-sensitive transfer image-receiving sheet, which has a substrate, and a dye receptor layer provided at least one side of the substrate, wherein the heat-sensitive transfer image-receiving sheet comprises at least one compound represented by formula (L1):

Formula (L1)

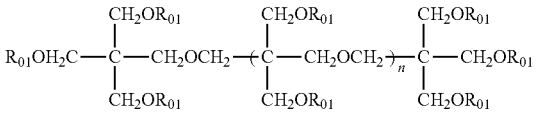

wherein $R_{01}$ represents —C(═O)R or a hydrogen atom, in which R represents an aliphatic group which may have a substituent, and a plurality of $R_{01}$'s are the same as or different from each other, but at least one of $R_{01}$'s is —C(═O)R; and n represents 0 or 1.

Further, the present invention resides in a method of producing the heat-sensitive transfer image-receiving sheet, wherein the method comprises a production step of: simultaneously multilayer-coating the substrate with each of coating solutions of the dye receptor layer and a layer or layers adjacent thereto.

Other and further features and advantages of the invention will appear more fully from the following description.

DETAILED DESCRIPTION OF THE INVENTION

According to the present invention, there is provided the following means:

(1) A heat-sensitive transfer image-receiving sheet, having a substrate, and a dye receptor layer provided at least one side of the substrate, wherein the heat-sensitive transfer image-receiving sheet comprises at least one compound represented by formula (L1):

Formula (L1)

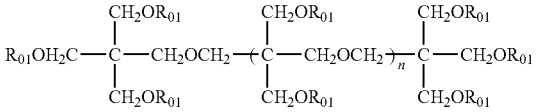

wherein $R_{01}$ represents —C(═O)R or a hydrogen atom, in which R represents an aliphatic group which may have a substituent, and a plurality of $R_{01}$'s are the same as or different from each other, but at least one of $R_{01}$'s is —C(═O)R; and n represents 0 or 1.

(2) The heat-sensitive transfer image-receiving sheet according to Item (1), wherein the compound represented by formula (L1) is contained in the receptor layer.

(3) The heat-sensitive transfer image-receiving sheet according to Item (1) or (2), wherein the receptor layer contains a latex polymer.

(4) The heat-sensitive transfer image-receiving sheet according to Item (3), wherein the latex polymer in the receptor layer is composed of a copolymer having a repeating unit derived from vinyl chloride.

(5) The heat-sensitive transfer image-receiving sheet according to any of Items (1) to (4), wherein the heat-sensitive transfer image-receiving sheet has a heat-insulating layer.

(6) The heat-sensitive transfer image-receiving sheet according to Item (5), wherein the heat-insulating layer comprises hollow latex polymer particles.

(7) The heat-sensitive transfer image-receiving sheet according to any of Items (1) to (6), wherein the receptor layer and/or the heat-insulating layer contains a water-soluble polymer.

(8) The heat-sensitive transfer image-receiving sheet according to Item (7), wherein the receptor layer and/or heat-insulating layer containing the water-soluble polymer contains a compound capable of crosslinking the water-soluble polymer, and the water-soluble polymer is partially or wholly crosslinked.

(9) A method of producing the heat-sensitive transfer image-receiving sheet according to any of Items (1) to (8), wherein the method comprises a production step of: simultaneously multilayer-coating the substrate with each of coating solutions of the dye receptor layer and a layer or layers adjacent thereto.

(10) The method of producing the heat-sensitive transfer image-receiving sheet according to Item (9), wherein layers provided by the simultaneously multilayer-coating step are those including the receptor layer and a heat-insulating layer provided between the receptor layer and the substrate.

The present invention is explained in detail below.

First, the compound represented by formula (L1) for use in the present invention is explained in detail.

Formula (L1)

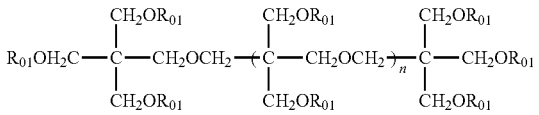

In the formula, $R_{01}$ represents —C(═O)R or a hydrogen atom, in which R represents an aliphatic group which may have a substituent. A plurality of $R_{01}$'s existing in the formula may be the same as or different from each other, but at least one of $R_{01}$'s is —C(═O)R. n represents 0 or 1.

R in $R_{01}$ represents an aliphatic group. Said aliphatic group may be a straight chain, branched, or cyclic aliphatic group, which may be saturated or unsaturated, and may have a substituent. As the aliphatic group, preferred are an alkyl group, an alkenyl group, an alkynyl group, a cycloalkyl group, or a cycloalkenyl group, each of which may have a substituent. Of these groups, more preferred is an alkyl group or an alkenyl group. The carbon number of said aliphatic group is preferably from 1 to 60, but the carbon number of the unsaturated aliphatic group is preferably from 2 to 60, the carbon number of the cycloalkyl group is preferably from 3 to 60 (more preferably from 5 to 60), and the carbon number of the cycloalkenyl group is preferably from 5 to 60. The carbon number of R is preferably from 3 to 50, more preferably from 5 to 50, further more preferably from 7 to 50, and most preferably from 11 to 30.

Examples of the substituent which the aliphatic group may have, include an aliphatic group, an aromatic group, a heterocyclic group (as the hetero ring moiety in said group, a 5- to 8-membered ring is preferred, and a 5- or 6-membered ring is more preferred; and the ring preferably contains any one of an oxygen atom, a sulfur atom and a nitrogen atom as a ring-forming atom; and further, the ring may be condensed with an alicyclic ring, an aromatic ring, or a hetero ring, or may have a substituent.), a halogen atom, a hydroxyl group, a mercapto group, a cyano group, a nitro group, a sulfo group, a carboxyl group, a sulfonyl group, a sulfinyl group, an amino group, an aliphatic amino group, an aromatic amino group, a heterocyclic amino group, an aliphatic oxy group, an aromatic oxy group, a heterocyclic oxy group, an aliphatic thio group, an aromatic thio group, a heterocyclic thio group, an acyl group, an acylamino group, an sulfonamido group, a sulfamoyl group, a carbamoyl group, an imido group, an acyloxy group, a ureido group, a urethane group, and an aliphatic or aromatic oxycarbonyl group. Of these substituents, preferred are an aliphatic group, a hydroxyl group, an amino group, an aliphatic amino group, an acylamino group, a sulfonamido group, an acyloxy group, and an aliphatic oxy group. An aliphatic group, a hydroxyl group, and an amino group are more preferred.

More specifically, of the compounds represented by formula (L1), preferred are those produced by acylating the compound in which each of $R_{01}$'s in formula (L1) is a hydrogen atom.

Acylation may be performed with a single acylating agent (R in —C(═O)R is single), or alternatively with a plurality of acylating agents (Rs in —C(═O)R are plural kinds, preferably two kinds). In that case, a ratio of acylated OH groups to all the OH groups of alcohol derivatives (dierythritol or trierythritol) of the above described raw materials is indicated as a substitution degree, assuming that the substitution degree be 100 in the case where all the OH groups have been acylated. The substitution degree is preferably from 50 to 100, more preferably from 60 to 100, furthermore preferably from 70 to 100, still more preferably from 80 to 100, still furthermore preferably from 90 to 100, and most preferably 100.

R's in a plurality of $R_{01}$'s are preferably the same as each other.

Examples of the acylating agent include RC(═O)X, in which X represents OH, $OR_A$, or $OC(=O)R_B$, and $R_A$ represents an alkyl group or an aryl group, and $R_B$ represents an aliphatic group. The acylating agent can be synthesized easily, according to an ordinary esterification reaction.

A molecular mass of the compound represented by formula (L1) is preferably from 900 to 4,000, more preferably from 1,000 to 3,000.

Specific examples of the compound represented by formula (L1) for use in the present invention are shown below, but the invention is not limited to those compounds.

TABLE 1

| Compound No. | n | $R_{01}$ | Substitution degree | $R_{01}$ | Substitution degree | $R_{01}$ | Substitution degree | Molecular mass |
|---|---|---|---|---|---|---|---|---|
| L1-101 | 0 | stearoyl | 100 | — | — | — | — | 1850 |
| L1-102 | 0 | stearoyl | 83 | hydrogen atom | 17 | — | — | 1568 |
| L1-103 | 0 | stearoyl | 67 | hydrogen atom | 33 | — | — | 1286 |
| L1-104 | 0 | isostearoyl | 50 | isooctanoyl | 50 | — | — | 1430 |
| L1-105 | 0 | stearoyl | 50 | isostearoyl | 50 | — | — | 1850 |
| L1-106 | 0 | hydroxylstearoyl | 67 | stearoyl | 33 | — | — | 1914 |
| L1-107 | 0 | hydroxylstearoyl | 33 | isostearoyl | 33 | hydrogen atom | 34 | 1318 |
| L1-108 | 0 | hydroxylstearoyl | 50 | isostearoyl | 50 | — | — | 1898 |
| L1-109 | 0 | isostearoyl | 50 | myristoyl | 50 | — | — | 1682 |
| L1-110 | 0 | isostearoyl | 83 | isononanoyl | 17 | — | — | 1724 |
| L1-111 | 0 | isooctanoyl | 50 | myristoyl | 50 | — | — | 1262 |
| L1-112 | 0 | hydroxystearoyl | 67 | oleoyl | 33 | — | — | 1910 |
| L1-113 | 0 | isostearoyl | 67 | oleoyl | 17 | hydrogen atom | 16 | 1566 |
| L1-114 | 0 | isostearoyl | 50 | docosanoyl | 17 | hydrogen atom | 33 | 1390 |
| L1-115 | 1 | isostearoyl | 100 | — | — | — | — | 2500 |
| L1-116 | 1 | isostearoyl | 88 | hydrogen atom | 12 | — | — | 2246 |
| L1-117 | 1 | isostearoyl | 75 | hydrogen atom | 25 | — | — | 1964 |
| L1-118 | 1 | isostearoyl | 50 | isooctanoyl | 50 | — | — | 1968 |
| L1-119 | 1 | isooctanoyl | 50 | myristoyl | 50 | — | — | 1744 |
| L1-120 | 1 | hydroxylstearoyl | 75 | oleoyl | 25 | — | — | 2620 |

Besides, R is preferably an unsubstituted aliphatic group.

Specific examples of —C(═O)R include groups of octanoyl, t-octanoyl, i-octanoyl, nonanoyl, isononanoyl, lauroyl, myristoyl, palmitoyl, stearoyl, isostearoyl, docosanoyl, oleoyl, 13-docosynoyl, and hydroxystearoyl.

In the present invention, at least one compound represented by formula (L1) is to be incorporated into the image-receiving sheet. A plurality of compounds represented by formula (L1) is also preferably incorporated. Namely, it is also a preferable embodiment to incorporate the compounds represented by formula (L1) as a mixture thereof.

General Synthesis Method

The compound represented by formula (L1) for use in the present invention can be synthesized, according to an ordinary esterification reaction, such as a method of making a carboxylic acid react with dipentaerythritol or trierythritol in the presence of acid catalyst, or the like, as described above.

The compound represented by formula (L1) is preferably incorporated in a receptor layer that is explained below. Further, the compound is more preferably used as a releasing (stripping) agent.

The heat-sensitive transfer sheet as well as the receptor layer is further explained in detail below.

In the heat-sensitive transfer image-receiving sheet of the present invention, at least a dye receptor layer (a receptor layer) is provided on or over a substrate (hereinafter, also referred to as a support, in some cases). In the present invention, it is preferable that a heat-insulating layer is further provided between the support and the receptor layer. Further, it is preferable to form an undercoat layer between the receptor layer and the support. As the undercoat layer, for example, any of a white background control layer, a charge-control layer, an adhesive layer, and a primer layer can be formed. Also, the heat insulation layer is preferably formed between the undercoat layer and the support. It is preferable that a curling-control layer, a writing layer, or a charge-control layer be formed on the backside of the support. Each of these layers is applied using a usual method, such as a roll coating, a bar coating, a gravure coating, a gravure reverse coating, a dye coating, a slide coating and a curtain coating. In practicing the present invention, a method capable of conducting a simultaneous multi-layer coating, such as the slide coating and the curtain coating, is preferable.

(Receptor Layer)

The receptor layer performs functions of receiving dyes transferred from an ink sheet and retaining an image formed. The image-receiving sheet of the present invention has at least one receptor layer preferably containing at least one thermoplastic receiving polymer that can receive a dye. Further, the receptor layer preferably contains a dispersion of the releasing agent that is explained in the present specification.

The receptor polymer is preferably used in the form of latex polymer in which the polymer is dispersed in an aqueous dispersion medium. Further, the receptor layer preferably contains a water soluble polymer in addition to the latex polymer. Incorporation of both the latex polymer and the water soluble polymer enables to arrange the water soluble polymer that is hardly colored with a dye among the latex polymer, so that diffusion of the dye with which the latex polymer has been colored can be prevented. Consequently, a fluctuation in sharpness of the receptor layer with the lapse of time can be reduced, and it is possible to form a recorded image with a little change of a transfer image with the lapse of time.

In the receptor layer, the latex polymer that is used as a receptor polymer can be used together with another functional latex polymer for purposes, such as regulation of elastic coefficient of the film. The receptor layer may be a single layer or double or more multi-layers.

<Latex Polymer>

The latex polymer (polymer latex) that can be used in the present invention is explained.

In the heat-sensitive transfer image-receiving sheet of the present invention, the latex polymer that can be used in the receptor layer is a dispersion in which a water-insoluble hydrophobic polymer is dispersed as fine particles in a water-soluble dispersion medium. As the latex polymer, several different kinds of latex polymer can be used in combination. As the latex polymer for use in the present invention, it is preferred to use at least one latex polymer containing at least a vinyl chloride monomer as a monomer unit, namely a repeating (recurring) unit derived from vinyl chloride.

The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. Latex polymers are described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki, and Keishi Kasahara, issued by Kobunshi Kanko Kai (1993); Soichi Muroi, "Gosei Latex no Kagaku (Chemistry of Synthetic Latex)", issued by Kobunshi Kanko Kai (1970); Yoshiaki Miyosawa (supervisor) "Suisei Coating-Zairyo no Kaihatsu to Oyo (Development and Application of Aqueous Coating Material)", issued by CMC Publishing Co., Ltd. (2004) and JP-A-64-538, and so forth. In the present invention, the average diameter of the dispersed particles is preferably in the range of approximately 1 to 50,000 nm, more preferably 5 to 1,000 nm.

The latex polymer for use in the present invention may be latex of the so-called core/shell type, other than ordinary latex polymer of a uniform structure. When using a core/shell type latex polymer, it is preferred in some cases that the core and the shell have different glass transition temperatures. The glass transition temperature (Tg) of the latex polymer for use in the present invention is preferably −30° C. to 100° C., more preferably 0° C. to 80° C., further more preferably 10° C. to 70° C., and especially preferably 15° C. to 60° C.

The glass transition temperature (Tg) can be calculated according to the following equation:

$$1/Tg=\Sigma(Xi/Tgi)$$

wherein, assuming that the polymer is a copolymer composed of n monomer components from i=1 to i=n, Xi is a mass fraction of the i-th monomer ($\Sigma Xi=1$) and Tgi is glass transition temperature (measured in absolute temperature) of a homopolymer formed from the i-th monomer. The symbol $\Sigma$ means the sum of i=1 to i=n. The value of the glass transition temperature of a homopolymer formed from each monomer (Tgi) is adopted from J. Brandrup and E. H. Immergut, "Polymer Handbook, 3rd. Edition", Wiley-Interscience (1989).

As preferable embodiments of a latex polymer containing a repeating unit derived from vinyl chloride used in the receptor layer in the present invention, use may be preferably made of a polyvinyl chloride, a copolymer comprising vinyl chloride monomer unit, such as a vinyl chloride/vinyl acetate copolymer and a vinyl chloride/acrylate copolymer. In case of the copolymer, the vinyl chloride unit in molar ratio is preferably in the range of from 50 mass % to 95 mass %. These polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular mass of each of these polymers is preferably 5,000 to 1,000,000, and further preferably 10,000 to 500,000 in terms of number average molecular mass. Polymers having excessively small molecular mass impart insufficient dynamic strength to the layer containing the latex, and polymers having excessively large molecular mass bring about poor film-forming ability. Crosslinkable latex polymers are also preferably used.

The latex polymer containing a repeating unit derived from vinyl chloride that can be used in the present invention is commercially available, and polymers described below may be utilized. Examples thereof include G351 and G576 (trade names, manufactured by Nippon Zeon Co., Ltd.); VINYBLAN 240, 270, 277, 375, 386, 609, 550, 601, 602, 630, 660, 671, 683, 680, 680S, 681N, 685R, 277, 380, 381, 410, 430, 432, 860, 863, 865, 867, 900, 900GT, 938 and 950 (trade names, manufactured by Nissin Chemical Industry Co., Ltd.).

In the present invention, another latex polymer that can be used with the latex polymer containing a repeating unit derived from vinyl chloride (vinyl chloride-based latex) in combination, is not particularly limited, but hydrophobic polymers, such as acrylic-series polymers, polyesters, rubbers (e.g., SBR resins), polyurethanes, polyvinyl chlorides, polyvinyl acetates, polyvinylidene chlorides, and polyolefins, are preferably used. These polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular mass of each of these polymers is preferably 5,000 to 1,000,000, and further preferably 10,000 to 500,000 in terms of number average molecular mass. A polymer having an excessively small molecular mass imparts insufficient dynamic strength to a layer containing a latex of the polymer, and a polymer having an excessively large molecular mass brings about poor film-forming ability. Crosslinkable latex polymers are also preferably used.

No particular limitation is imposed on a monomer to be used in synthesizing the latex polymer having the aforementioned another structure that can be used in combination with the latex polymer containing a repeating unit derived from vinyl chloride in the present invention, and the following monomer groups (a) to (j) may be preferably used as those polymerizable in a usual radical polymerization or ion polymerization method. These monomers may be selected singly or combined freely to synthesize the latex polymer.

—Monomer Groups (a) to (j)—

(a) Conjugated dienes: 1,3-pentadiene, isoprene, 1-phenyl-1,3-butadiene, 1-α-naphthyl-1,3-butadiene, 1-β-naphthyl-1,3-butadiene, cyclopentadiene, etc.

(b) Olefins: ethylene, propylene, vinyl chloride, vinylidene chloride, 6-hydroxy-1-hexene, 4-pentenoic acid, methyl 8-nonenate, vinylsulfonic acid, trimethylvinylsilane, trimethoxyvinylsilane, 1,4-divinylcyclohexane, 1,2,5-trivinylcyclohexane, etc.

(c) α,β-unsaturated carboxylates: alkyl acrylates, such as methyl acrylate, ethyl acrylate, butyl acrylate, cyclohexyl acrylate, 2-ethylhexyl acrylate, and dodecyl acrylate; substituted alkyl acrylates, such as 2-chloroethyl acrylate, benzyl acrylate, and 2-cyanoethyl acrylate; alkyl methacrylates, such as methyl methacrylate, butyl methacrylate, 2-ethylhexyl methacrylate, and dodecyl methacrylate; substituted alkyl methacrylates, such as 2-hydroxyethyl methacrylate, glycidyl methacrylate, glycerin monomethacrylate, 2-acetoxyethyl methacrylate, tetrahydrofurfuryl methacrylate, 2-methoxyethyl methacrylate, polypropylene glycol monomethacrylates (mole number of added polyoxypropylene=2 to 100), 3-N,N-dimethylaminopropyl methacrylate, chloro-3-N,N,N-trimethylammoniopropyl methacrylate, 2-carboxyethyl methacrylate, 3-sulfopropyl methacrylate, 4-oxysulfobutyl methacrylate, 3-trimethoxysilylpropyl methacrylate, allyl methacrylate, and 2-isocyanatoethyl methacrylate; derivatives of unsaturated dicarboxylic acids, such as monobutyl maleate, dimethyl maleate, monomethyl itaconate, and dibutyl itaconate; multifunctional esters, such as ethylene glycol diacrylate, ethylene glycol dimethacrylate, 1,4-cyclohexane diacrylate, pentaerythritol tetramethacrylate, pentaerythritol triacrylate, trimethylolpropane triacrylate, trimethylolethane triacrylate, dipentaerythritol pentamethacrylate, pentaerythritol hexaacrylate, and 1,2,4-cyclohexane tetramethacrylate; etc.

(d) α,β-unsaturated carboxylic acid amides: acrylamide, methacrylamide, N-methylacrylamide, N,N-dimethylacrylamide, N-methyl-N-hydroxyethylmethacrylamide, N-tert-butylacrylamide, N-tert-octylmethacrylamide, N-cyclohexylacrylamide, N-phenylacrylamide, N-(2-acetoacetoxyethyl) acrylamide, N-acryloylmorpholine, diacetone acrylamide, itaconic diamide, N-methylmaleimide, 2-acrylamide-methylpropane sulfonic acid, methylenebisacrylamide, dimethacryloylpiperazine, etc.

(e) Unsaturated nitriles: acrylonitrile, methacrylonitrile, etc.

(f) Styrene and derivatives thereof: styrene, vinyltoluene, p-tert-butylstyrene, vinylbenzoic acid, methyl vinylbenzoate, α-methylstyrene, p-chloromethylstyrene, vinyinaphthalene, p-hydroxymethylstyrene, sodium p-styrenesulfonate, potassium p-styrenesulfinate, p-aminomethylstyrene, 1,4-divinylbenzene, etc.

(g) Vinyl ethers: methyl vinyl ether, butyl vinyl ether, methoxyethyl vinyl ether, etc.

(h) Vinyl esters: vinyl acetate, vinyl propionate, vinyl benzoate, vinyl salicylate, vinyl chloroacetate, etc.

(i) α,β-unsaturated carboxylic acids and salts thereof: acrylic acid, methacrylic acid, itaconic acid, maleic acid, sodium acrylate, ammonium methacrylate, potassium itaconate, etc.

(j) Other polymerizable monomers: N-vinylimidazole, 4-vinylpyridine, N-vinylpyrrolidone, 2-vinyloxazoline, 2-isopropenyloxazoline, divinylsulfone, etc.

Latex polymers that can be used in combination are also commercially available, and polymers described below may be utilized. Examples of the acrylic-series polymers include Cevian A-4635, 4718, and 4601 (trade names, manufactured by Daicel Chemical Industries); Nipol Lx811, 814, 821, 820, 855 (P-17: Tg 36° C.), and 857x2 (P-18: Tg 43° C.) (trade names, manufactured by Nippon Zeon Co., Ltd.); Voncoat R3370 (P-19: Tg 25° C.), and 4280 (P-20: Tg 15° C.) (trade names, manufactured by Dai-Nippon Ink & Chemicals, Inc.); Julimer ET-410 (P-21: Tg 44° C.) (trade name, manufactured by Nihon Junyaku K.K.); AE116 (P-22: Tg 50° C.), AE119 (P-23: Tg 55° C.), AE121 (P-24: Tg 58° C.), AE125 (P-25: Tg 60° C.), AE134 (P-26: Tg 48° C.), AE137 (P-27: Tg 48° C.), AE140 (P-28: Tg 53° C.), and AE173 (P-29: Tg 60° C.) (trade names, manufactured by JSR Corporation); Aron A-104 (P-30: Tg 45° C.) (trade name, manufactured by Toagosei Co., Ltd.); NS-600X, and NS-620X (trade names, manufactured by Takamatsu Yushi K.K.); VINYBLAN 2580, 2583, 2641, 2770, 2770H, 2635, 2886, 5202C, and 2706 (trade names, manufactured by Nissin Chemical Industry Co., Ltd.).

Examples of the polyesters include FINETEX ES650, 611, 675, and 850 (trade names, manufactured by Dainippon Ink and Chemicals, Incorporated); WD-size, and WMS (trade names, manufactured by Eastman Chemical Ltd.); A-110, A-115GE, A-120, A-121, A-124GP, A-124S, A-160P, A-210, A-215GE, A-510, A-513E, A-515GE, A-520, A-610, A-613, A-615GE, A-620, WAC-10, WAC-15, WAC-17XC, WAC-20, S-110, S-110EA, S-111SL, S-120, S-140, S-140A, S-250, S-252G, S-250S, S-320, S-680, DNS-63P, NS-122L, NS-122LX, NS-244LX, NS-140L, NS-141 LX, and NS-282LX (trade names, manufactured by Takamatsu Yushi K.K.); Aronmelt PES-1000 series, and PES-2000 series (trade names, manufactured by Toagosei Co., Ltd.); Bironal MD-1100, MD-1200, MD-1220, MD-1245, MD-1250, MD-1335, MD-1400, MD-1480, MD-1500, MD-1930, and MD-1985 (trade names, manufactured by Toyobo Co., Ltd.); and Ceporjon ES (trade name, manufactured by Sumitomo Seika Chemicals Co., Ltd.).

Examples of the polyurethanes include HYDRAN AP10, AP20, AP30, AP40, and 101H, Vondic 1320NS and 1610NS (trade names, manufactured by Dainippon Ink and Chemicals, Incorporated); D-1000, D-2000, D-6000, D-4000, and D-9000 (trade names, manufactured by Dainichi Seika Color & Chemicals Mfg. Co., Ltd.); NS-155XX, NS-310A, NS-310X, and NS-311X (trade names, manufactured by Takamatsu Yushi K.K.); Elastron (trade name, manufactured by Dai-ichi Kogyo Seiyaku Co., Ltd.).

Examples of the rubbers include LACSTAR 7310K, 3307B, 4700H, and 7132C (trade names, manufactured by Dainippon Ink & Chemicals Incorporated); Nipol Lx416, LX410, LX430, LX435, LX110, LX415A, LX438C, 2507H, LX303A, LX407BP series, V1004, and MH5055 (trade names, manufactured by Nippon Zeon Co., Ltd.).

Examples of the polyolefins include Chemipearl S120, SA100, and V300 (P-40: Tg 80° C.) (trade names, manufactured by Mitsui Petrochemical); Voncoat 2830, 2210, and 2960 (trade names, manufactured by Dainippon Ink and Chemicals, Incorporated); Zaikusen and Ceporjon G (trade names, manufactured by Sumitomo Seika Chemicals Co., Ltd.).

Examples of the copolymer nylons include Ceporjon PA (trade name, manufactured by Sumitomo Seika Chemicals Co., Ltd.).

Examples of the polyvinyl acetates include VINYBLAN 1080, 1082, 1085W, 1108W, 1108S, 1563M, 1566, 1570, 1588C, A22J7-F2, 1128C, 1137, 1138, A20J2, A23J1, A23J1, A23K1, A23P2E, A68J1N, 1086A, 1086, 1086D, 1108S, 1187, 1241LT, 1580N, 1083, 1571, 1572, 1581, 4465, 4466, 4468W, 4468S, 4470, 4485LL, 4495LL, 1023, 1042, 1060, 1060S, 1080M, 1084W, 1084S, 1096, 1570K, 1050, 1050S, 3290, 1017AD, 1002, 1006, 1008, 1107L, 1225, 1245L, GV-6170, GV-6181, 4468W, and 4468S (trade names, manufactured by Nisshin Chemical Industry Co., Ltd.).

These latex polymers may be used singly, or two or more of these polymers may be blended, if necessary.

In the receptor layer in the present invention, a ratio of the latex polymer comprising a component of vinyl chloride is preferably 50 mass % or more of the whole solid content in the layer.

The glass transition temperature (Tg) of the latex polymer having another structure that can be used in combination with the latex polymer comprising vinyl chloride as a monomer unit used in the present invention, is preferably in the range of −30° C. to 70° C., more preferably −10° C. to 50° C., still more preferably 0° C. to 40° C., in view of film-forming properties (brittleness for working) and image preservability. A blend of two or more types of polymers can be used as the binder. When a blend of two or more polymers is used, the average Tg obtained by summing up the Tg of each polymer weighted by its proportion, is preferably within the foregoing range. Also, when phase separation occurs or when a core-shell structure is adopted, the weighted average Tg is preferably within the foregoing range.

The latex polymer for use in the present invention preferably has a minimum film-forming temperature (M FT) of from −30 to 90° C., more preferably from 0 to 70° C. In order to control the minimum film-forming temperature, a film-forming aid may be added. The film-forming aid is also called a temporary plasticizer, and it is an organic compound (usually an organic solvent) that lowers the minimum film-forming temperature of a latex polymer. It is described in, for example, Souichi Muroi, "Gosei Latex no Kagaku (Chemistry of Synthetic Latex)", issued by Kobunshi Kanko Kai (1970). Preferable examples of the film-forming aid are listed below, but the compounds that can be used in the present invention are not limited to the following specific examples.

Z-1: Benzyl alcohol

Z-2: 2,2,4-Trimethylpentanediol-1,3-monoisobutyrate

Z-3: 2-Dimethylaminoethanol

Z-4: Diethylene glycol

The latex polymer for use in the present invention can be easily obtained by a solution polymerization method, a suspension polymerization method, an emulsion polymerization method, a dispersion polymerization method, an anionic polymerization method, a cationic polymerization method, or the like. Above all, an emulsion polymerization method in which the polymer is obtained as a latex is the most preferable. Also, a method is preferable in which the polymer is prepared in a solution, and the solution is neutralized, or an emulsifier is added to the solution, to which water is then added, to prepare an aqueous dispersion by forced stirring. For example, an emulsion polymerization method comprises conducting polymerization under stirring at about 30° C. to about 100° C. (preferably 60° C. to 90° C.) for 3 to 24 hours by using water or a mixed solvent of water and a water-miscible organic solvent (such as methanol, ethanol, or acetone) as a dispersion medium, a monomer mixture in an amount of 5 mass % to 150 mass % based on the amount of the dispersion medium, an emulsifier and a polymerization initiator. Various conditions, such as the dispersion medium, the monomer concentration, the amount of initiator, the amount of emulsifier, the amount of dispersant, the reaction temperature, and the method for adding monomers, are suitably determined considering the type of the monomers to be used. Furthermore, it is preferable to use a dispersant when necessary.

Generally, the emulsion polymerization method can be conducted according to the disclosures of the following documents: "Gosei Jushi Emarujon (Synthetic Resin Emulsions)" (edited by Taira Okuda and Hiroshi Inagaki and published by Kobunshi Kankokai (1978)); "Gosei Ratekkusu no Oyo (Applications of Synthetic Latexes)" (edited by Takaaki Sugimura, Yasuo Kataoka, Soichi Suzuki, and Keiji Kasahara and published by Kobunshi Kankokai (1993)); and "Gosei Ratekkusu no Kagaku (Chemistry of Synthetic Latexes)" (edited by Soichi Muroi and published by Kobunshi Kankokai (1970)). The emulsion polymerization method for synthesizing the latex polymer for use in the present invention may be a batch polymerization method, a monomer (continuous or divided) addition method, an emulsion addition method, or a seed polymerization method. The emulsion polymerization method is preferably a batch polymerization method, a monomer (continuous or divided) addition method, or an emulsion addition method in view of the productivity of latex.

The polymerization initiator may be any polymerization initiator having radical generating ability. The polymerization initiator to be used may be selected from inorganic peroxides, such as persulfates and hydrogen peroxide, peroxides as described in the organic peroxide catalogue of NOF Corporation, and azo compounds as described in the azo polymerization initiator catalogue of Wako Pure Chemical Industries, Ltd. Among them, water-soluble peroxides, such as persulfates, and water-soluble azo compounds as described in the azo polymerization initiator catalogue of Wako Pure Chemical Industries, Ltd. are preferable; ammonium persulfate, sodium persulfate, potassium persulfate, azobis(2-methylpropionamidine) hydrochloride, azobis(2-methyl-N-(2-hydroxyethyl)propionamide), and azobiscyanovaleric acid are more preferable; and peroxides, such as ammonium persulfate, sodium persulfate, and potassium persulfate, are especially preferable from the viewpoints of image preservability, solubility, and cost.

The amount of the polymerization initiator to be added is, based on the total amount of monomers, preferably 0.3 mass % to 2.0 mass %, more preferably 0.4 mass % to 1.75 mass %, and especially preferably 0.5 mass % to 1.5 mass %.

The polymerization emulsifier to be used may be selected from anionic surfactants, nonionic surfactants, cationic surfactants, and ampholytic surfactants. Among them, anionic surfactants are preferable from the viewpoints of dispersibility and image preservability. Sulfonic acid type anionic surfactants are more preferable because polymerization stability can be ensured even with a small addition amount and they have resistance to hydrolysis. Long chain alkyldiphenyl ether disulfonic acid salts (whose typical example is PELEX SS-H (trade name) manufactured by Kao Corporation,) are still more preferable, and low electrolyte types, such as PIONIN A-43-S (trade name, manufactured by Takemoto Oil & Fat Co., Ltd.) are especially preferable.

The amount of sulfonic acid type anionic surfactant as the polymerization emulsifier is preferably 0.1 mass % to 10.0 mass %, more preferably 0.2 mass % to 7.5 mass %, and especially preferably 0.3 mass % to 5.0 mass %, based on the total amount of monomers.

It is preferable to use a chelating agent in synthesizing the latex polymer to be used in the present invention. The chelating agent is a compound capable of coordinating (chelating) a polyvalent ion, such as (transition) metal ion (e.g., iron ion) or alkaline earth metal ion (e.g., calcium ion), and examples of the chelate compound which can be used include the compounds described in JP-B-6-8956 ("JP-B" means examined Japanese patent publication), U.S. Pat. No. 5,053,322, JP-A-4-73645, JP-A-4-127145, JP-A-4-247073, JP-A-4-305572, JP-A-6-11805, JP-A-5-173312, JP-A-5-66527, JP-A-5-158195, JP-A-6-118580, JP-A-6-110168, JP-A-6-161054, JP-A-6-175299, JP-A-6-214352, JP-A-7-114161, JP-A-7-114154, JP-A-7-120894, JP-A-7-199433, JP-A-7-306504, JP-A-9-43792, JP-A-8-314090, JP-A-10-182571, JP-A-10-182570, and JP-A-11-190892.

Preferred examples of the chelating agent include inorganic chelate compounds (e.g., sodium tripolyphosphate, sodium hexametaphosphate, sodium tetrapolyphosphate), aminopolycarboxylic acid-based chelate compounds (e.g., nitrilotriacetic acid, ethylenediaminetetraacetic acid), organic phosphonic acid-based chelate compounds (e.g., compounds described in Research Disclosure, No. 18170, JP-A-52-102726, JP-A-53-42730, JP-A-56-97347, JP-A-54-121127, JP-A-55-4024, JP-A-55-4025, JP-A-55-29883, JP-A-55-126241, JP-A-55-65955, JP-A-55-65956, JP-A-57-179843, JP-A-54-61125, and West German Patent No. 1045373), polyphenol-based chelating agents, and polyamine-based chelate compounds, with aminopolycarboxylic acid derivatives being particularly preferred.

Preferred examples of the aminopolycarboxylic acid derivative include the compounds shown in the Table attached to "EDTA (—Complexane no Kagaku—) (EDTA—Chemistry of Complexane—)", Nankodo (1977). In these compounds, a part of the carboxyl groups may be substituted by an alkali metal salt, such as sodium or potassium or by an ammonium salt. More preferred examples of the aminopolycarboxylic acid derivative include iminodiacetic acid, N-methyliminodiacetic acid, N-(2-aminoethyl)iminodiacetic acid, N-(carbamoylmethyl)iminodiacetic acid, nitrilotriacetic acid, ethylenediamine-N,N'-diacetic acid, ethylenediamine-N,N'-di-α-propionic acid, ethylenediamine-N,N'-di-β-propionic acid, N,N'-ethylene-bis(α-o-hydroxyphenyl)glycine, N,N'-di(2-hydroxybenzyl)ethylenediamine-N,N'-diacetic acid, ethylenediamine-N,N'-diacetic acid-N,N'-diacetohydroxamic acid, N-hydroxyethylethylenediamine-N,N',N'-triacetic acid, ethylenediamine-N,N,N',N'-tetraacetic acid, 1,2-propylenediamine-N,N,N',N'-tetraacetic acid, d,l-2,3-diaminobutane-N,N,N',N'-tetraacetic acid, meso-2,3-diaminobutane-N,N,N',N'-tetraacetic acid, 1-phenylethylenediamine-N,N,N',N'-tetraacetic acid, d,l-1,2-diphenylethylenediamine-N,N,N',N'-tetraacetic acid, 1,4-diaminobutane-N,N,N',N'-tetraacetic acid, trans-cyclobutane-1,2-diamine-N,N,N',N'-tetraacetic acid, trans-cyclopentane-1,2-diamine-N,N,N',N'-tetraacetic acid, trans-cyclohexane-1,2-diamine-N,N,N',N'-tetraacetic acid, cis-cyclohexane-1,2-diamine-N,N,N',N'-tetraacetic acid, cyclohexane-1,3-diamine-N,N,N',N'-tetraacetic acid, cyclohexane-1,4-diamine-N,N,N',N'-tetraacetic acid, o-phenylenediamine-N,N,N',N'-tetraacetic acid, cis-1,4-diaminobutene-N,N,N',N'-tetraacetic acid, trans-1,4-diaminobutene-N,N,N',N'-tetraacetic acid, α,α'-diamino-o-xylene-N,N,N',N'-tetraacetic acid, 2-hydroxy-1,3-propanediamine-N,N,N',N'-tetraacetic acid, 2,2'-oxy-bis(ethyliminodiacetic acid), 2,2'-ethylenedioxy-bis(ethyliminodiacetic acid), ethylenediamine-N,N'-diacetic acid-N,N'-di-α-propionic acid, ethylenediamine-N,N'-diacetic acid-N,N'-di-β-propionic acid, ethylenediamine-N,N,N',N'-tetrapropionic acid, diethylenetriamine-N,N,N',N",N"-pentaacetic acid, triethylenetetramine-N,N,N',N",N'",N'"-hexaacetic acid, and 1,2,3-triaminopropane-N,N,N',N",N'",N'"-hexaacetic acid. In these compounds, a part of the carboxyl groups may be substituted by an alkali metal salt, such as sodium or potassium or by an ammonium salt.

The amount of the chelating agent to be added is preferably 0.01 mass % to 0.4 mass %, more preferably 0.02 mass % to 0.3 mass %, and especially preferably 0.03 mass % to 0.15 mass %, based on the total amount of monomers. When the addition amount of the chelating agent is too small, metal ions entering during the preparation of the latex polymer are not sufficiently trapped, and the stability of the latex against aggregation is lowered, whereby the coating properties become worse. When the amount is too large, the viscosity of the latex increases, whereby the coating properties are lowered.

In the preparation of the latex polymer to be used in the present invention, it is preferable to use a chain transfer agent. As the chain transfer agent, ones described in Polymer Handbook (3rd Edition) (Wiley-Interscience, 1989) are preferable. Sulfur compounds are more preferable because they have high chain-transfer ability and because the required amount is small. Especially, hydrophobic mercaptane-based chain transfer agents, such as tert-dodecylmercaptane and n-dodecylmercaptane are preferable.

The amount of the chain transfer agent to be added is preferably 0.2 mass % to 2.0 mass %, more preferably 0.3 mass % to 1.8 mass %, and especially preferably 0.4 mass % to 1.6 mass %, based on the total amount of monomers.

Besides the foregoing compounds, in the emulsion polymerization, use can be made of additives, such as electrolytes, stabilizers, thickeners, defoaming agents, antioxidants, vulcanizers, antifreezing agents, gelling agents, and vulcanization accelerators, as described, for example, in Synthetic Rubber Handbook.

In the present invention, it is preferable to prepare the latex polymer by applying an aqueous type coating solution and then drying it. The "aqueous type" so-called herein means that 60% by mass or more of the solvent (dispersion medium) of the coating solution is water. As a component other than water in the coating solution, a water miscible organic solvent may be used, such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

The latex polymer in the image-receiving sheet used in the present invention includes a state of a gel or dried film formed by removing a part of solvents by drying after coating.

<Releasing Agent>

As the releasing agent for use in the present invention, it is preferred to use the compound represented by formula (L1) described above.

The form of the releasing agent may be any form, such as liquid, paste, or solid at room temperature, but preferably solid or paste, more preferably solid.

In the case where the releasing agent for use in the present invention is used in a solvent-based coating solution, it is preferred to use the releasing agent as it is.

In the case where the releasing agent for use in the present invention is used in a water-based coating solution, it is preferred to add an emulsified dispersion of the releasing agent to a heat-sensitive transfer image-receiving sheet. The emulsified dispersion is produced under the conditions by controlling, for example, the kind of a dispersing agent, the density or viscosity of a binder, the stirring conditions, the dispersing time, and the dispersing temperature, whereby the particle size can be made more homogeneous. However, a slight amount of coarse grains still remains in the emulsified dispersion, or coarse grains are formed by coalescence of grains during storage of the emulsified dispersion, which results in one of factors deteriorating the state of coated surface at the time of production of the heat-sensitive transfer image-receiving sheet. For prevention from formation of such the coarse oil droplets, a molecular mass of the releasing agent for use in the present invention is preferably not less than 1,250, more preferably not less than 1,400, and furthermore preferably not less than 1,600. The upper limit of the molecular mass is not particularly limited, in so far as the aforementioned purpose can be attained, but the upper limit is generally not more than 10,000, preferably not more than 7,000, and more preferably not more than 5,000.

If the compound represented by formula (L1) is used as a releasing agent in the heat-sensitive transfer image-receiving sheet of the present invention, no reverse transfer of the releasing agent to an ink sheet occurs at the time of thermal transfer, a function of the releasing agent is effectively exhibited by a high thermal energy at a high density portion, and the releasing agent is hardly dissolved by a low thermal energy at the time of transfer of the protective layer, as compared to previous releasing agents. Therefore, it is assumed that coexistence of efficiency of the releasing agent and transferring property of the protective layer can be achieved by the compound of formula (L1) according to the present invention.

The releasing agent according to the present invention can be used, by adding it to a coating solution as an emulsified dispersion which is produced by emulsifying and dispersing the releasing agent in a gelatin aqueous solution by using an anionic surface active agent, such as sodium dodecylbenzenesulfonate and sodium oleoylmethyltaurine. The emulsified dispersion can be produced according to a known method using tools, such as a homogenizer, dissolver, and Manton-Gaulin emulsifier. In the emulsified dispersion, use may be made of an additive(s), such as an auxiliary solvent and an antiseptics, in addition to the surface active agent.

The releasing agent for use in the present invention is preferably added to the receptor layer. An addition amount of the releasing agent is preferably in the range of from 0.5 mass % to 30 mass %, more preferably in the range of from 1 mass % to 20 mass %, and furthermore preferably in the range of from 1.5 mass % to 15 mass %, based on the total solid content of the receptor layer. Further, the releasing agent for use in the present invention may be used together with any other releasing agents as an aid therefor. In this connection, it is preferred to control a ratio of the releasing agent for use in the present invention to the total amount of entire releasing agents in the range of from 50 mass % to 100 mass %, whereby effects of the present invention can be favorably exhibited.

<Water-Soluble Polymer>

The receptor layer preferably contains a water-soluble polymer. The water-soluble polymer which can be used in the present invention is any of natural polymers (polysaccharide type, microorganism type, and animal type), semi-synthetic polymers (cellulose-based, starch-based, and alginic acid-based), and synthetic polymer type (vinyl type and others); and synthetic polymers including polyvinyl alcohols, and natural or semi-synthetic polymers using celluloses derived from plant as starting materials, which will be explained later, correspond to the water-soluble polymer usable in the present invention. The latex polymers recited above are not included in the water-soluble polymers which can be used in the present invention. In the present invention, the water-soluble polymer is also referred to as a binder, for differentiation from the latex polymer described above.

Herein, the "water-soluble polymer" means a polymer which dissolves, in 100 g water at 20° C., in an amount of preferably 0.05 g or more, more preferably 0.1 g or more, further preferably 0.5 g or more, and particularly preferably 1 g or more.

Among the water-soluble polymers which can be used in the present invention, the natural polymers and the semi-synthetic polymers will be explained in detail. Specific examples include the following polymers: plant type polysaccharides, such as gum arabics, κ-carrageenans, ι-carrageenans, λ-carrageenans, guar gums (e.g. Supercol, manufactured by Squalon), locust bean gums, pectins, tragacanths, corn starches (e.g. Purity-21, manufactured by National Starch & Chemical Co.), and phosphorylated starches (e.g. National 78-1898, manufactured by National Starch & Chemical Co.); microbial type polysaccharides, such as xanthan gums (e.g. Keltrol T, manufactured by Kelco) and dextrins (e.g. Nadex 360, manufactured by National Starch & Chemical Co.); animal type natural polymers, such as gelatins (e.g. Crodyne B419, manufactured by Croda), caseins, sodium chondroitin sulfates (e.g. Cromoist CS, manufactured by Croda); cellulose-based polymers, such as ethylcelluloses (e.g. Cellofas WLD, manufactured by I.C.I.), carboxymethylcelluloses (e.g. CMC, manufactured by Daicel), hydroxyethylcelluloses (e.g. HEC, manufactured by Daicel), hydroxypropylcelluloses (e.g. Klucel, manufactured by Aqualon), methylcelluloses (e.g. Viscontran, manufactured by Henkel), nitrocelluloses (e.g. Isopropyl Wet, manufactured by Hercules), and cationated celluloses (e.g. Crodacel QM, manufactured by Croda); starches, such as phosphorylated starches (e.g. National 78-1898, manufactured by National Starch & Chemical Co.); alginic acid-based compounds, such as sodium alginates (e.g. Keltone, manufactured by Kelco) and propylene glycol alginates; and other polymers, such as cationated guar gums (e.g. Hi-care 1000, manufactured by Alcolac) and sodium hyaluronates (e.g. Hyalure, manufactured by Lifecare Biomedial) (all of the names are trade names).

Gelatin is one of preferable embodiments in the present invention. Gelatin having a molecular mass of from 10,000 to 1,000,000 may be used in the present invention. Gelatin that can be used in the present invention may contain an anion, such as $Cl^-$ and $SO_4^{2-}$, or alternatively a cation, such as $Fe^{2+}$, $Ca^{2+}$, $Mg^{2+}$, $Sn^{2+}$, and $Zn^{2+}$. Gelatin is preferably added as an aqueous solution.

Among the water-soluble polymers which can be used in the present invention, the synthetic polymers will be explained in detail. Examples of the acryl type include sodium polyacrylates, polyacrylic acid copolymers, polyacrylamides, polyacrylamide copolymers, and polydiethylaminoethyl(meth)acrylate quaternary salts or their copolymers. Examples of the vinyl type include polyvinylpyrrolidones, polyvinylpyrrolidone copolymers, and polyvinyl alcohols. Examples of the others include polyethylene glycols, polypropylene glycols, polyisopropylacrylamides, polymethyl vinyl ethers, polyethyleneimines, polystyrenesulfonic acids or their copolymers, naphthalenesulfonic acid condensate salts, polyvinylsulfonic acids or their copolymers, polyacrylic acids or their copolymers, acrylic acid or its copolymers, maleic acid copolymers, maleic acid monoester copolymers, acryloylmethylpropanesulfonic acid or its copolymers, polydimethyldiallylammonium chlorides or their copolymers, polyamidines or their copolymers, polyimidazolines, dicyanamide type condensates, epichlorohydrin/dimethylamine condensates, Hofmann decomposed products of polyacrylamides, and water-soluble polyesters (Plascoat Z-221, Z-446, Z-561, Z-450, Z-565, Z-850, Z-3308, RZ-105, RZ-570, Z-730 and RZ-142 (all of these names are trade names), manufactured by Goo Chemical Co., Ltd.).

In addition, use may also be made of highly-water-absorptive polymers, namely, homopolymers of vinyl monomers having —COOM or —$SO_3$M (M represents a hydrogen atom or an alkali metal atom) or copolymers of these vinyl monomers among them or with other vinyl monomers (for example, sodium methacrylate, ammonium methacrylate, Sumikagel L-5H (trade name) manufactured by Sumitomo Chemical Co., Ltd.), as described in, for example, U.S. Pat. No. 4,960,681 and JP-A-62-245260.

Among the water-soluble synthetic polymers that can be used in the present invention, polyvinyl alcohols are preferable.

The polyvinyl alcohols are explained in detail below.

Examples of completely saponificated polyvinyl alcohol include PVA-105 [polyvinyl alcohol (PVA) content: 94.0 mass % or more; degree of saponification: 98.5±0.5 mol %; content of sodium acetate: 1.5 mass % or less; volatile constituent: 5.0 mass % or less; viscosity (4 mass %; 20° C.): 5.6±0.4 CPS]; PVA-110 [PVA content: 94.0 mass %; degree of saponification: 98.5±0.5 mol %; content of sodium acetate: 1.5 mass %; volatile constituent: 5.0 mass %; viscosity (4 mass %; 20° C.): 11.0±0.8 CPS]; PVA-117 [PVA content: 94.0 mass %; degree of saponification: 98.5±0.5 mol %; content of sodium acetate: 1.0 mass %; volatile constituent: 5.0 mass %; viscosity (4 mass %; 20° C.): 28.0±3.0 CPS]; PVA-117H [PVA content: 93.5 mass %; degree of saponification: 99.6±0.3 mol %; content of sodium acetate: 1.85 mass %; volatile constituent: 5.0 mass %; viscosity (4 mass %; 20° C.): 29.0±3.0 CPS]; PVA-120 [PVA content: 94.0 mass %; degree of saponification: 98.5±0.5 mol %; content of sodium acetate: 1.0 mass %; volatile constituent: 5.0 mass %; viscosity (4 mass %; 20° C.): 39.5±4.5 CPS]; PVA-124 [PVA content: 94.0 mass %; degree of saponification: 98.5±0.5 mol %; content of sodium acetate: 1.0 mass %; volatile constituent: 5.0 mass %; viscosity (4 mass %; 20° C.): 60.0±6.0 CPS]; PVA-124H [PVA content: 93.5 mass %; degree of saponification: 99.6±0.3 mol %; content of sodium acetate: 1.85 mass %; volatile constituent: 5.0 mass %; viscosity (4 mass %; 20° C.): 61.0±6.0 CPS]; PVA-CS [PVA content: 94.0 mass %; degree of saponification: 97.5±0.5 mol %; content of sodium acetate: 1.0 mass %; volatile constituent: 5.0 mass %; viscosity (4 mass %; 20° C.): 27.5±3.0 CPS]; PVA-CST [PVA content: 94.0 mass %; degree of saponification: 96.0±0.5 mol %; content of sodium acetate: 1.0 mass %; volatile constituent: 5.0 mass %; viscosity (4 mass %; 20° C.): 27.0±3.0 CPS]; and PVA-HC [PVA content: 90.0 mass %; degree of saponification: 99.85 mol % or more; content of sodium acetate: 2.5 mass %; volatile constituent: 8.5 mass %; viscosity (4 mass %; 20° C.): 25.0±3.5 CPS] (all trade names, manufactured by Kuraray Co., Ltd.), and the like.

Examples of partially saponificated polyvinyl alcohol include PVA-203 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.4±0.2 CPS]; PVA-204 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.9±0.3 CPS]; PVA-205 [PVA content: 94.0 mass %; degree of saponification: 88.0±1.5 mol %; content of sodium acetate: 1.0 mass %; volatile constituent: 5.0 mass %; viscosity (4 mass %; 20° C.): 5.0±0.4 CPS]; PVA-210 [PVA content: 94.0 mass %; degree of saponification: 88.0±1.0 mol %; content of sodium acetate: 1.0 mass %; volatile constituent: 5.0 mass %; viscosity (4 mass %; 20° C.): 9.0±1.0 CPS]; PVA-217 [PVA content: 94.0 mass %; degree of saponification: 88.0±1.0 mol %; content of sodium acetate: 1.0 mass %; volatile constituent: 5.0 mass %; viscosity (4 mass %; 20° C.): 22.5±2.0 CPS]; PVA-220 [PVA content: 94.0 mass %; degree of saponification: 88.0±1.0 mol %; content of sodium acetate: 1.0 mass %; volatile constituent: 5.0 mass %; viscosity (4 mass %; 20° C.): 30.0±3.0 CPS]; PVA-224 [PVA content: 94.0 mass %; degree of saponification: 88.0±1.5 mol %; content of sodium acetate: 1.0 mass %; volatile constituent: 5.0 mass %; viscosity (4 mass %; 20° C.): 44.0±4.0 CPS]; PVA-228 [PVA content: 94.0 mass %; degree of saponification: 88.0±1.5 mol %; content of sodium acetate: 1.0 mass %; volatile constituent: 5.0 mass %; viscosity (4 mass %; 20° C.): 65.0±5.0 CPS]; PVA-235 [PVA content: 94.0 mass %; degree of saponification: 88.0±1.5 mol %; content of sodium acetate: 1.0 mass %; volatile constituent: 5.0 mass %; viscosity (4 mass %; 20° C.): 95.0±15.0 CPS]; PVA-217EE [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-217E [PVA content: 94.0 mass %; degree of saponification: 88.0±1.0 mmol %; content of sodium acetate: 1.0 mass %; volatile constituent: 5.0 mass %; viscosity (4 mass %; 20° C.): 23.0±3.0 CPS]; PVA-220E [PVA content: 94.0 mass %; degree of saponification: 88.0±1.0 mol %; content of sodium acetate: 1.0 mass %; volatile constituent: 5.0 mass %; viscosity (4 mass %; 20° C.): 31.0±4.0 CPS]; PVA-224E [PVA content: 94.0 mass %; degree of saponification: 88.0±1.0 mol %; content of sodium acetate: 1.0 mass %; volatile constituent: 5.0 mass %; viscosity (4 mass %; 20° C.): 45.0±5.0 CPS]; PVA-403 [PVA content: 94.0 mass %; degree of saponification: 80.0±1.5 mol %; content of sodium acetate: 1.0 mass %; volatile constituent: 5.0 mass %; viscosity (4 mass %; 20° C.): 3.1±0.3 CPS]; PVA-405 [PVA content: 94.0 mass %; degree of saponification: 81.5±1.5 mol %; content of sodium acetate: 1.0 mass %; volatile constituent: 5.0 mass %; viscosity (4 mass %; 20° C.): 4.8±0.4 CPS]; PVA-420 [PVA content: 94.0 mass %; degree of saponification: 79.5±1.5 mol %; content of sodium acetate: 1.0 mass %; volatile constituent: 5.0 mass %]; PVA-613 [PVA content: 94.0 mass %; degree of saponification: 93.5±1.0 mol %; content of sodium acetate: 1.0 mass %; volatile constituent: 5.0 mass %; viscosity (4 mass %; 20° C.): 16.5±2.0 CPS]; L-8 [PVA content: 96.0 mass %; degree of saponification: 71.0±1.5 mol %; content of sodium acetate: 1.0 mass % (ash); volatile constituent: 3.0 mass %; viscosity (4 mass %; 20° C.): 5.4±0.4 CPS] (all trade names, manufactured by Kuraray Co., Ltd.), and the like.

The above values were measured in the manner according to JIS K-6726-1977.

With respect to modified polyvinyl alcohols, those described in Koichi Nagano, et al., "Poval", Kobunshi Kankokai, Inc. are useful. The modified polyvinyl alcohols include polyvinyl alcohols modified by cations, anions, —SH compounds, alkylthio compounds, or silanols.

Examples of such modified polyvinyl alcohols (modified PVA) include C polymers, such as C-118, C-318, C-318-2A, and C-506 (all being trade names of Kuraray Co., Ltd.); HL polymers, such as HL-12E and HL-1203 (all being trade names of Kuraray Co., Ltd.); HM polymers, such as HM-03 and HM-N-03 (all being trade names of Kuraray Co., Ltd.); K polymers, such as KL-118, KL-318, KL-506, KM-118T, and KM-618 (all being trade names of Kuraray Co., Ltd.); M polymers, such as M-115 (a trade name of Kuraray Co., Ltd.); MP polymers, such as MP-102, MP-202, and MP-203 (all being trade names of Kuraray Co., Ltd.); MPK polymers, such as MPK-1, MPK-2, MPK-3, MPK-4, MPK-5, and MPK-6 (all being trade names of Kuraray Co., Ltd.); R polymers, such as R-1130, R-2105, and R-2130 (all being trade names of Kuraray Co., Ltd.); and V polymers, such as V-2250 (a trade name of Kuraray Co., Ltd.).

The viscosity of polyvinyl alcohol can be adjusted or stabilized by adding a trace amount of a solvent or an inorganic salt to an aqueous solution of polyvinyl alcohol, and use may be made of compounds described in the aforementioned reference "Poval", Koichi Nagano et al., published by Kobunshi Kankokai, pp. 144-154. For example, a coated-surface quality can be improved by an addition of boric acid, and the addition of boric acid is preferable. The amount of boric acid to be added is preferably 0.01 to 40 mass %, with respect to polyvinyl alcohol.

Preferred binders are transparent or semitransparent, and generally colorless. Examples include natural resins, polymers and copolymers; synthetic resins, polymers, and copolymers; and other media that form films: for example, rubbers, polyvinyl alcohols, hydroxyethyl celluloses, cellulose acetates, cellulose acetate butylates, polyvinylpyrrolidones, starches, polyacrylic acids, polymethyl methacrylates, polyvinyl chlorides, polymethacrylic acids, styrene/maleic acid anhydride copolymers, styrene/acrylonitrile copolymers, styrene/butadiene copolymers, polyvinylacetals (e.g., polyvinylformals and polyvinylbutyrals), polyesters, polyurethanes, phenoxy resins, polyvinylidene chlorides, polyepoxides, polycarbonates, polyvinyl acetates, polyolefins, cellulose esters, and polyamides. These media are water-soluble.

In the present invention, preferred water-soluble polymers are polyvinyl alcohols and gelatin, with gelatin being most preferred.

The amount of the water-soluble polymer to be added to the receptor layer is preferably from 1 to 25% by mass, more preferably from 1 to 10% by mass, based on the entire mass of the receptor layer.

<Hardening Agent>

A hardening agent that is used in the present invention as a crosslinking agent, may be added to a coating layer of the image-receiving sheet, such as a receptor layer, a heat-insulating layer, and a subbing layer. Herein, the term "crosslinking agent" is also referred to as a compound or crosslinking agent capable of crosslinking a water-soluble polymer.

Preferable examples of the hardener that can be used in the present invention include H-1, 4, 6, 8, and 14 in JP-A-1-214845 in page 17; compounds (H-1 to H-54) represented by one of formulae (VII) to (XII) in U.S. Pat. No. 4,618,573, columns 13 to 23; compounds (H-1 to H-76) represented by formula (6) in JP-A-2-214852, page 8, the lower right (particularly, H-14); and compounds described in claim 1 in U.S. Pat. No. 3,325,287. Examples of the hardening agent include hardening agents described, for example, in U.S. Pat. No. 4,678,739, column 41, U.S. Pat. No. 4,791,042, JP-A-59-116655, JP-A-62-245261, JP-A-61-18942, and JP-A-4-218044. More specifically, an aldehyde-series hardening agent (formaldehyde, etc.), an aziridine-series hardening agent, an epoxy-series hardening agent, a vinyl sulfone-series hardening agent (N,N'-ethylene-bis(vinylsulfonylacetamido) ethane, etc.), an N-methylol-series hardening agent (dimethylol urea, etc.), a boric acid, a metaboric acid, or a polymer hardening agent (compounds described, for example, in JP-A-62-234157), can be mentioned.

Preferable examples of the hardener include a vinylsulfone-series hardener and chlorotriazines.

More preferable hardeners in the present invention are compounds represented by formula (B) or (C).

$$(CH_2{=}CH{-}SO_2)_n\text{-}L \qquad \text{Formula (B)}$$

$$(X{-}CH_2{-}CH_2{-}SO_2)_n\text{-}L \qquad \text{Formula (C)}$$

In formulae (B) and (C), X represents a halogen atom, L represents an organic linking group having n-valency. When the compound represented by formula (B) or (C) is a low-molecular compound, n denotes an integer from 1 to 4. When the compound represented by formula (B) or (C) is a high-molecular (polymer) compound, L represents an organic linking group containing a polymer chain, and n denotes an integer in the range of from 10 to 1,000.

In formulae (B) and (C), X is preferably a chlorine atom or a bromine atom, and further preferably a bromine atom. n is an integer from 1 to 4, preferably an integer from 2 to 4, more preferably 2 or 3, and most preferably 2.

L represents an organic group having n-valency, and preferably an aliphatic hydrocarbon group, an aromatic hydrocarbon group or a heterocyclic group, and any of these groups may be combined through an ether bond, ester bond, amide bond, sulfonamide bond, urea bond, urethane bond, or the like. Also, each of these groups may be further substituted. Examples of the substituent include a halogen atom, alkyl group, aryl group, heterocyclic group, hydroxyl group, alkoxy group, aryloxy group, alkylthio group, arylthio group, acyloxy group, alkoxycarbonyl group, carbamoyloxy group, acyl group, acyloxy group, acylamino group, sulfonamido group, carbamoyl group, sulfamoyl group, sulfonyl group, phosphoryl group, carboxyl group, or sulfo group. Among these groups, a halogen atom, alkyl group, hydroxy group, alkoxy group, aryloxy group, or acyloxy group is preferable.

Specific examples of the vinylsulfone-series hardener include the following compounds (VS-1) to (VS-27), although the present invention is not limited to those.

$$CH_2{=}CH{-}SO_2{-}CH_2{-}SO_2{-}CH{=}CH_2 \qquad \text{(VS-1)}$$

$$CH_2{=}CH{-}SO_2{-}CH_2CH_2{-}SO_2{-}CH{=}CH_2 \qquad \text{(VS-2)}$$

-continued (VS-3)

$CH_2{=}CH{-}SO_2{-}CH_2CH_2CH_2{-}SO_2{-}CH{=}CH_2$ (VS-4)

$CH_2{=}CH{-}SO_2{-}CH_2CH(CH_3){-}SO_2{-}CH{=}CH_2$ (VS-5)

$CH_2{=}CH{-}SO_2{-}CH_2OCH_2{-}SO_2{-}CH{=}CH_2$ (VS-6)

$CH_2{=}CH{-}SO_2{-}CH_2CH_2OCH_2CH_2{-}SO_2{-}CH{=}CH_2$ (VS-7)

$CH_2{=}CH{-}SO_2{-}CH_2C(=O)NHCH_2CH_2NHC(=O)CH_2{-}SO_2{-}CH{=}CH_2$ (VS-8)

$CH_2{=}CH{-}SO_2{-}CH_2C(=O)NHCH_2CH_2CH_2NHC(=O)CH_2{-}SO_2{-}CH{=}CH_2$ (VS-9)

$CH_2{=}CH{-}SO_2{-}CH_2CH(OH)CH_2{-}SO_2{-}CH{=}CH_2$ (VS-10)

$CH_2{=}CH{-}SO_2{-}CH_2CH(OH)CH(OH)CH_2{-}SO_2{-}CH{=}CH_2$ (VS-11)

$CH_2{=}CH{-}SO_2{-}CH_2CH(OH)CH_2CH(OH)CH_2{-}SO_2{-}CH{=}CH_2$ (VS-12)

$CH_2{=}CH{-}SO_2{-}CH_2CH(OH)CH_2CH_2CH(OH)CH_2{-}SO_2{-}CH{=}CH_2$ (VS-13)

$CH_2{=}CH{-}SO_2{-}CH_2CH(OH)CH_2CH(CH_3)CH_2CH(OH)CH_2{-}SO_2{-}CH{=}CH_2$ (VS-14)

$CH_2{=}CH{-}SO_2{-}CH_2CH(OH)CH_2OCH_2CH(OH)CH_2{-}SO_2{-}CH{=}CH_2$ (VS-15)

$CH_2{=}CH{-}SO_2{-}CH_2CH(OH)CH_2C(=O)CH_2CH(OH)CH_2{-}SO_2{-}CH{=}CH_2$ (VS-16)

$CH_2{=}CH{-}SO_2{-}CH_2CH(OH)CH_2N(H)CH_2CH(OH)CH_2{-}SO_2{-}CH{=}CH_2$ (VS-17)

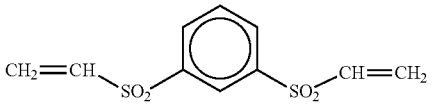

(VS-18)

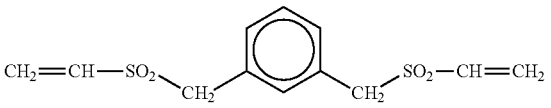

-continued (VS-19)

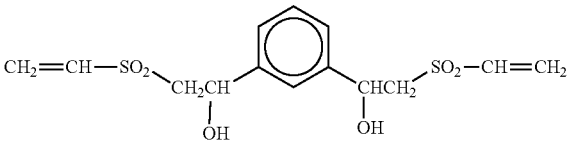

(VS-20)

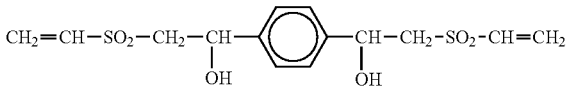

(VS-21)

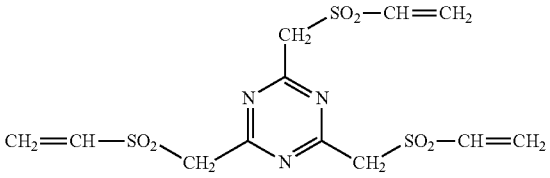

(VS-22)

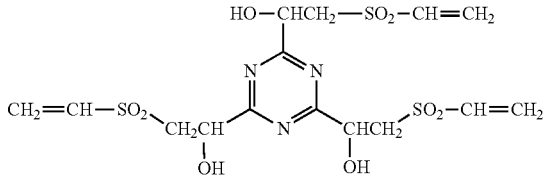

(VS-23)

$Cl{-}CH_2{-}CH_2{-}SO_2{-}CH_2{-}SO_2{-}CH_2{-}CH_2{-}Cl$ (VS-24)

$Br{-}CH_2{-}CH_2{-}SO_2{-}CH_2{-}SO_2{-}CH_2{-}CH_2{-}Br$ (VS-25)

$Br{-}CH_2{-}CH_2{-}SO_2{-}CH_2OCH_2{-}SO_2{-}CH_2{-}CH_2{-}Br$ (VS-26)

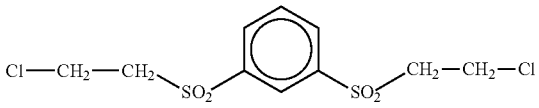

(VS-27)

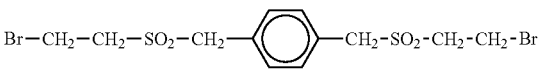

These hardeners may be obtained with reference to the method described in, for example, the specification of U.S. Pat. No. 4,173,481.

Furthermore, as the chlorotriazine-series hardener, a 1,3,5-triazine compound in which at least one of the 2-position, 4-position and 6-position of the triazine ring in the compound is substituted with a chlorine atom, is preferable. A 1,3,5-triazine compound in which two or three of the 2-position, 4-position and 6-position of the triazine ring each are substituted with a chlorine atom, is more preferable. Alternatively, use may be made of a 1,3,5-triazine compound in which at least one of the 2-position, 4-position and 6-position of the triazine ring is substituted with a chlorine atom, and the remainder position(s) is substituted with a group(s) or atom(s) other than a chlorine atom. Examples of these other groups or atom(s) include a hydrogen atom, a bromine atom, a fluorine atom, an iodine atom, an alkyl group, an alkenyl group, an alkynyl group, a cycloalkyl group, a cycloalkenyl group, an aryl group, a heterocyclic group, a hydroxy group, a nitro group, a cyano group, an amino group, a hydroxylamino group, an alkylamino group, an arylamino group, a heterocyclic amino group, an acylamino group, a sulfonamido group, a carbamoyl group, a sulfamoyl group, a sulfo group, a carboxyl group, an alkoxy group, an alkenoxy group, an aryloxy group, a heterocyclic oxy group, an acyl group, an acyloxy group, an alkyl- or aryl-sulfonyl group, an alkyl- or aryl-sulfinyl group, an alkyl- or aryl-sulfonyloxy group, a mercapto group, an alkylthio group, an alkenylthio group, an arylthio group, a heterocyclic thio group, and an alkyloxy- or aryloxy-carbonyl group.

Specific examples of the chlorotriazine-series hardener include 4,6-dichloro-2-hydroxy-1,3,5-triazine or its Na salt, 2-chloro-4,6-diphenoxytriazine, 2-chloro-4,6-bis[2,4,6-trimethylphenoxy]triazine, 2-chloro-4,6-diglycidoxy-1,3,5-triazine, 2-chloro-4-(n-butoxy)-6-glycidoxy-1,3,5-triazine, 2-chloro-4-(2,4,6-trimethylphenoxy)-6-glycidoxy-1,3,5-triazine, 2-chloro-4-(2-chloroethoxy)-6-(2,4,6-trimethylphenoxy)-1,3,5-triazine, 2-chloro-4-(2-bromoethoxy)-6-(2,4,6-trimethylphenoxy)-1,3,5-triazine, 2-chloro-4-(2-di-n-butylphosphatoethoxy)-6-(2,4,6-trimethylphenoxy)-1,3,5-triazine, and 2-chloro-4-(2-di-n-butylphosphatoethoxy)-6-(2,6-xylenoxy)-1,3,5-triazine, but the invention is not limited to those.

Such a compound can be easily produced by reacting cyanur chloride (namely, 2,4,6-trichlorotriazine) with, for example, a hydroxy compound, thio compound or amino compound corresponding to the target substituent on the hetero ring.

These hardeners are used in an amount of generally 0.001 to 1 g, preferably 0.005 to 0.5 g, per g of the water-soluble polymer.

<Emulsion>

The receptor layer of the heat-sensitive transfer image-receiving sheet of the present invention preferably contains an emulsion. The following is a detailed explanation of the emulsion that can be preferably used in the present invention.

Hydrophobic additives, such as a lubricant, an antioxidant, and the like, can be introduced into a layer of the image-receiving sheet (e.g. the receptor layer, the heat insulation layer, the undercoat layer), by using a known method described in U.S. Pat. No. 2,322,027, or the like. In this case, a high-boiling organic solvent, as described in U.S. Pat. No. 4,555,470, U.S. Pat. No. 4,536,466, U.S. Pat. No. 4,536,467, U.S. Pat. No. 4,587,206, U.S. Pat. No. 4,555,476 and U.S. Pat. No. 4,599,296, JP-B-3-62256, and the like, may be used singly or in combination with a low-boiling organic solvent having a boiling point of 50 to 160° C., according to the need. Also, these lubricants, antioxidants, and high-boiling organic solvents may be respectively used in combination of two or more of those.

As the antioxidant (hereinafter, also referred to as a radical trapper in this specification), a compound represented by any one of formulae (E-1) to (E-3) is preferably used.

Formula (E-1)

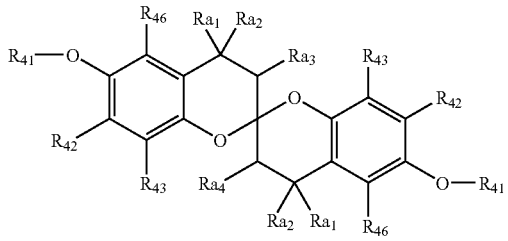

Formula (E-2)

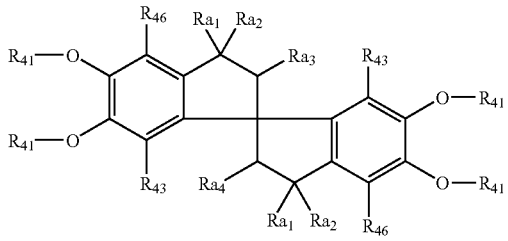

Formula (E-3)

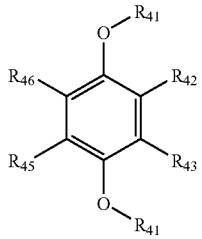

$R_{41}$ represents an aliphatic group, an aryl group, a heterocyclic group, an acyl group, an aliphatic oxycarbonyl group, an aryloxycarbonyl group, an aliphatic sulfonyl group, an arylsulfonyl group, a phosphoryl group, or a group —Si($R_{47}$)($R_{48}$)($R_{49}$) in which $R_{47}$, $R_{48}$ and $R_{49}$ each independently represent an aliphatic group, an aryl group, an aliphatic oxy group, or an aryloxy group. $R_{42}$ to $R_{46}$ each independently represent a hydrogen atom or a substituent. Examples of the substituent include a halogen atom, an aliphatic group (including an alkyl group, an alkenyl group, an alkynyl group, a cycloalkyl group, and a cycloalkenyl group), an aryl group, a heterocyclic group, a hydroxy group, a mercapto group, an aliphaticoxy group, an aryloxy group, a heterocyclic oxy group, an aliphaticthio group, an arylthio group, a heterocyclic thio group, an amino group, an aliphaticamino group, an arylamino group, a heterocyclic amino group, an acylamino group, a sulfonamido group, a cyano group, a nitro group, a carbamoyl group, a sulfamoyl group, an acyl group, an aliphatic oxycarbonyl group, and an aryloxycarbonyl group. $R_{a1}$, $R_{a2}$, $R_{a3}$, and $R_{a4}$ each independently represent a hydrogen atom, or an aliphatic group (for example, methyl, ethyl).

With respect to the compounds represented by any one of formulae (E-1) to (E-3), the groups that are preferred from the viewpoint of the effect to be exhibited by the present invention, are explained below.

In formulae (E-1) to (E-3), it is preferred that $R_{41}$ represents an aliphatic group, an acyl group, an aliphatic oxycarbonyl group, an aryloxycarbonyl group, or a phosphoryl group, and $R_{42}$, $R_{43}$, $R_{45}$, and $R_{46}$ each independently represent a hydrogen atom, an aliphatic group, an aliphatic oxy group, or an acylamino group. It is more preferred that $R_{41}$ represents an aliphatic group, and $R_{42}$, $R_{43}$, $R_{45}$ and $R_{46}$ each independently represent a hydrogen atom or an aliphatic group.

Preferable specific examples of the compounds represented by any one of formulae (E-1) to (E-3) are shown below, but the present invention is not limited to these compounds.

EB-1

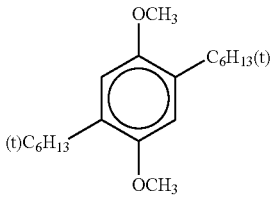

EB-2

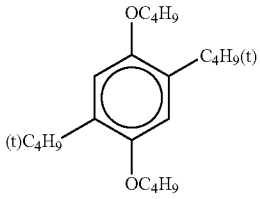

EB-3

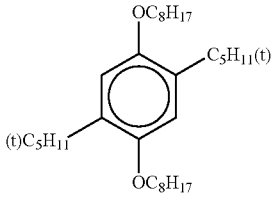

EB-4

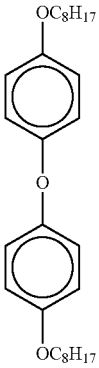

EB-5

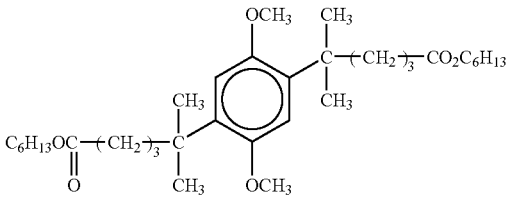

EB-6

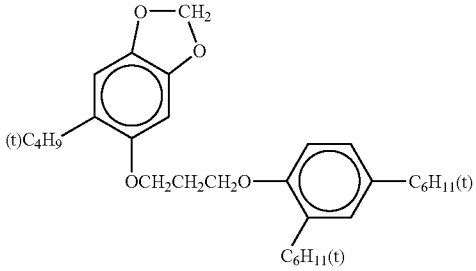

-continued

EB-7

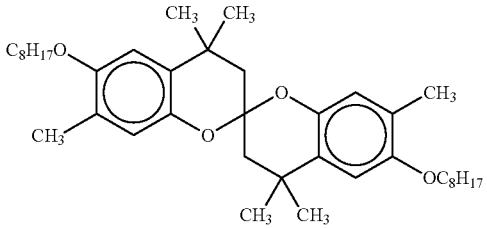

EB-8

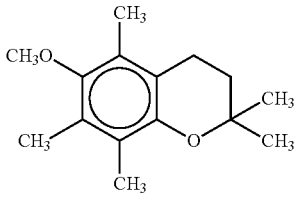

EB-9

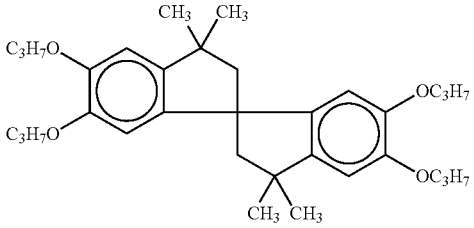

EB-10

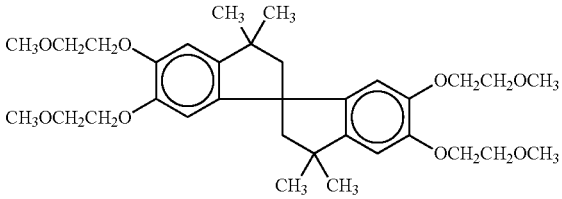

EB-11

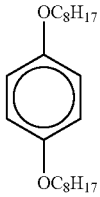

A content of the antioxidizing agent is preferably from 1.0 to 7.0 mass %, more preferably from 2.5 to 5.0 mass %, based on a solid content in the latex polymer.

<Auxiliary Releasing Agent>

In the receptor layer, for prevention from heat seal with a thermal transfer sheet (i.e. an ink sheet) at the time of image formation, the aforementioned high-molecular releasing agent may be blended with another compound(s) as an auxiliary releasing agent. As the auxiliary releasing agent, use may be made of any of silicone oil, phosphoric acid ester-series plasticizers, and fluorine compounds. Silicone oil is preferably used in particular. As the silicone oil, use may be preferably made of various modified silicone oil, such as those modified with any groups of epoxy, alkyl, amino, carboxyl, alcohol, fluorine, alkyl aralkyl polyether, epoxy polyether, or polyether. Of these modified silicone oils, it is preferred to use a reaction product of a vinyl modified silicone oil with a hydrogen modified silicone oil.

As the silicone oil as the lubricant, straight silicone oil and modified silicone oil or their hardened products may be used.

Examples of the straight silicone oil include dimethylsilicone oil, methylphenylsilicone oil, and methyl hydrogen silicone oil. Examples of the dimethylsilicone oil include KF96-10, KF96-100, KF96-1000, KF96H-10000, KF96H-12500, and KF96H-100000 (all of these names are trade names, manufactured by Shin-Etsu Chemical Co., Ltd.). Examples of the methylphenylsilicone oil include KF50-100, KF54, and KF56 (all of these names are trade names, manufactured by Shin-Etsu Chemical Co., Ltd.).

The modified silicone oil may be classified into reactive silicone oils and non-reactive silicone oils. Examples of the reactive silicone oil include amino-modified, epoxy-modified, carboxyl-modified, hydroxy-modified, methacryl-modified, mercapto-modified, phenol-modified, or one-terminal reactive/hetero-functional group-modified silicone oils. Examples of the amino-modified silicone oil include KF-393, KF-857, KF-858, X-22-3680, X-22-3801C, KF-8010, X-22-161A and KF-8012 (all of these names are trade names, manufactured by Shin-Etsu Chemical Co., Ltd.). Examples of the epoxy-modified silicone oil include KF-100T, KF-101, KF-60-164, KF-103, X-22-343 and X-22-3000T (all of these names are trade names, manufactured by Shin-Etsu Chemical Co., Ltd.). Examples of the carboxyl-modified silicone oil include X-22-162C (trade name, manufactured by Shin-Etsu Chemical Co., Ltd.). Examples of the hydroxy-modified silicone oil include X-22-160AS, KF-6001, KF-6002, KF-6003, X-22-170DX, X-22-176DX, X-22-176D and X-22-176DF (all of these names are trade names, manufactured by Shin-Etsu Chemical Co., Ltd.). Examples of the methacryl-modified silicone oil include X-22-164A, X-22-164C, X-24-8201, X-22-174D and X-22-2426 (all of these names are trade names, manufactured by Shin-Etsu Chemical Co., Ltd.).

Reactive silicone oils may be hardened upon use, and may be classified into a reaction-curable type, a photocurable type, a catalyst-curable type, and the like. Among these types, silicone oil that is the reaction-curable type is particularly preferable. As the reaction-curable type silicone oil, use is preferable made of a product which is obtained by making an amino-modified silicone oil to react with an epoxy-modified silicone oil, followed by curing. Also, examples of the catalyst-curable type or photocurable type silicone oil include KS-705F-PS, KS-705F-PS-1 and KS-770-PL-3 (all of these names are trade names, catalyst-curable silicone oils, manufactured by Shin-Etsu Chemical Co., Ltd.), and KS-720 and KS-774-PL-3 (all of these names are trade names, photocurable silicone oils, manufactured by Shin-Etsu Chemical Co., Ltd.). The addition amount of the curable type silicone oil is preferably 0.5 to 30% by mass, based on the resin constituting the receptor layer. The releasing agent is used preferably in an amount of 2 to 4% by mass, and further preferably 2 to 3% by mass, based on 100 parts by mass of the polyester resin. If the amount is too small, the releasability cannot be secured without fail, whereas if the amount is excessive, a protective layer is not transferred to the image-receiving sheet resultantly.

Examples of the non-reactive silicone oil include polyether-modified, methylstyryl-modified, alkyl-modified, higher fatty acid ester-modified, hydrophilic special-modified, higher alkoxy-modified, or fluorine-modified silicone oils. Examples of the polyether-modified silicone oil include KF-6012 (trade name, manufactured by Shin-Etsu Chemical Co., Ltd.), and examples of the methylstyryl-modified silicone oil include 24-510, and KF41-410 (all of these names are trade names, manufactured by Shin-Etsu Chemical Co., Ltd.). Modified silicones represented by any one of formulae 1 to 3 may also be used.

Formula 1

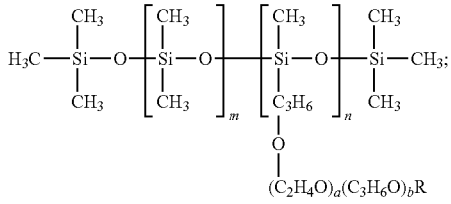

In formula 1, R represents a hydrogen atom, or a straight-chain or branched alkyl group which may be substituted with an aryl or cycloalkyl group. m and n each denote an integer of 2,000 or less, and a and b each denote an integer of 30 or less.

Formula 2

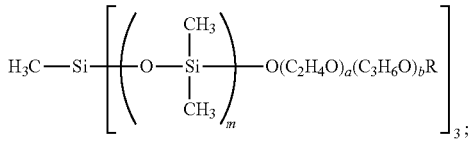

In formula 2, R represents a hydrogen atom, or a straight-chain or branched alkyl group which may be substituted with an aryl or cycloalkyl group. m denotes an integer of 2,000 or less, and a and b each denote an integer of 30 or less.

Formula 3

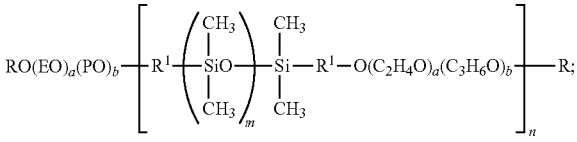

In formula 3, R represents a hydrogen atom, or a straight-chain or branched alkyl group which may be substituted with an aryl or cycloalkyl group. m and n each denote an integer of 2,000 or less, and a and b each denote an integer of 30 or less. $R^1$ represents a single bond or a divalent linking group, E represents an ethylene group which may have a substituent, and P represents a propylene group which may have a substituent.

Silicone oils, such as those mentioned above, are described in "SILICONE HANDBOOK" (The Nikkan Kogyo Shimbun, Ltd.), and the techniques described in JP-A-8-108636 and JP-A-2002-264543 may be preferably used as the technique to cure the curable type silicone oils.

Examples of the high-boiling organic solvent include phthalates (e.g., dibutyl phthalate, dioctyl phthalate, di-2-ethylhexyl phthalate), phosphates or phosphonates (e.g., triphenyl phosphate, tricresyl phosphate, tri-2-ethylhexyl phosphate), fatty acid esters (e.g., di-2-ethylhexyl succinate, tributyl citrate), benzoates (e.g., 2-ethylhexyl benzoate, dodecyl benzoate), amides (e.g., N,N-diethyldodecane amide, N,N-dimethylolein amide), alcohols or phenols (e.g., isostearyl alcohol, 2,4-di-tert-amyl phenol), anilines (e.g., N,N-dibutyl-2-butoxy-5-tert-octylaniline), chlorinated paraffins, hydrocarbons (e.g., dodecylbenzene, diisopropylnaphthalene), and carboxylic acids (e.g., 2-(2,4-di-tert-amylphenoxy)butyrate).

Preferably, any of the compounds shown below can be used.

(Solv-1)

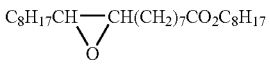

(Solv-2)

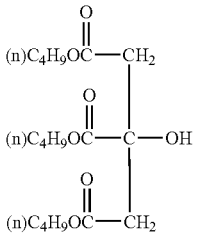

(Solv-3)

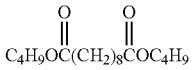

(Solv-4)

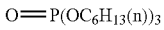

(Solv-5)

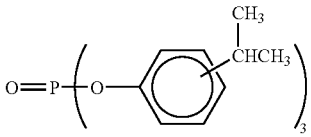

(Solv-6)

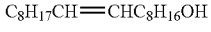

(Solv-7)

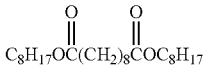

(Solv-8)

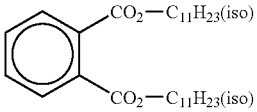

(Solv-9)

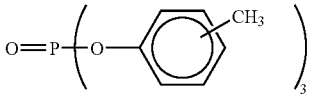

Further, the high-boiling organic solvent may be used in combination with, as an auxiliary solvent, an organic solvent having a boiling point of 30° C. or higher but 160° C. or lower, such as ethyl acetate, butyl acetate, methyl ethyl ketone, cyclohexanone, methylcellosolve acetate, or the like. The high-boiling organic solvent is used in an amount of generally 10 g or less, preferably 5 g or less, and more preferably 1 to 0.1 g, per g of the hydrophobic additives to be used. The amount is also preferably 1 ml or less, more preferably 0.5 ml or less, and particularly preferably 0.3 ml or less, per g of the binder.

A dispersion method that uses a polymer, as described in JP-B-51-39853 and JP-A-51-59943, and a method in which the addition is made with them in the form of a dispersion of fine particles, as described in, for example, JP-A-62-30242, can also be used. In the case of a compound that is substantially insoluble in water, other than the above methods, a method can be used in which the compound is dispersed and contained in the form of fine particles in a binder.

When the hydrophobic compound is dispersed in a hydrophilic colloid, various surfactants may be used. For example, those listed as examples of the surfactant in JP-A-59-157636, pages 37 to 38 may be used. It is also possible to use phosphates-based surfactants described in JP-A-7-56267, JP-A-7-228589, and West German Patent Application Laid-Open (OLS) No. 1,932,299A.

<Ultraviolet Absorber>

Also, in the present invention, in order to improve light resistance, an ultraviolet absorber may be added to the receptor layer. In this case, when this ultraviolet absorber is made to have a higher molecular mass, it can be secured to the receptor layer so that it can be prevented, for instance, from being diffused into the ink sheet and from being sublimated and vaporized by heating.

As the ultraviolet absorber, compounds having various ultraviolet absorber skeletons, which are widely known in the field of information recording, may be used. Specific examples of the ultraviolet absorber may include compounds having a 2-hydroxybenzotriazole-type ultraviolet absorber skeleton, 2-hydroxybenzotriazine-type ultraviolet absorber skeleton, or 2-hydroxybenzophenon-type ultraviolet absorber skeleton. Compounds having a benzotriazole-type or triazine-type skeleton are preferable from the viewpoint of ultraviolet absorbing ability (absorption coefficient) and stability, and compounds having a benzotriazole-type or benzophenone-type skeleton are preferable from the viewpoint of obtaining a higher-molecular mass and using in a form of a latex. Specifically, ultraviolet absorbers described in, for example, JP-A-2004-361936 may be used.

The ultraviolet absorber preferably absorbs light at wavelengths in the ultraviolet region, and the absorption edge of the absorption of the ultraviolet absorber is preferably out of the visible region. Specifically, when it is added to the receptor layer to form a heat-sensitive transfer image-receiving sheet, the heat-sensitive transfer image-receiving sheet has a reflection density of, preferably, Abs 0.5 or more at 370 nm, and more preferably Abs 0.5 or more at 380 nm. Also, the heat-sensitive transfer image-receiving sheet has a reflection density of, preferably, Abs 0.1 or less at 400 nm. If the reflection density at a wavelength range exceeding 400 nm is high, it is not preferable because an image is made yellowish.

In the present invention, the ultraviolet absorber is preferably made to have a higher molecular mass. The ultraviolet absorber has a mass average molecular mass of preferably 10,000 or more, and more preferably 100,000 or more. As a means of obtaining a higher-molecular mass ultraviolet absorber, it is preferable to graft an ultraviolet absorber on a polymer. The polymer as the principal chain preferably has a polymer skeleton less capable of being dyed than the receptor polymer to be used together. Also, when the polymer is used to form a film, the film preferably has sufficient film strength. The graft ratio of the ultraviolet absorber to the polymer principal chain is preferably 5 to 20% by mass, more preferably 8 to 15% by mass.

Furthermore, it is more preferable that the ultraviolet-absorber-grafted polymer is made to be used in a form of a latex. When the polymer is made to be used in a form of a latex, an aqueous dispersion-system coating solution may be used in application and coating to form the receptor layer, and this enables reduction of production cost. As a method of making the latex polymer (or making the polymer latex-wise), a method described in, for example, Japanese Patent No. 3450339, may be used. As the ultraviolet absorber to be used in a form of a latex, the following commercially available ultraviolet absorbers may be used, which include ULS-700, ULS-1700, ULS-1383MA, ULS-1635 MH, XL-7016, ULS-933LP, and ULS-935LH, manufactured by Ipposha Oil Industries Co., Ltd.; and New Coat UVA-1025W, New Coat UVA-204W, and New Coat UVA-4512M, manufactured by Shin-Nakamura Chemical Co., Ltd. (all of these names are trade names).

In the case of making an ultraviolet-absorber-grafted polymer into a form of a latex, it may be mixed with a latex of the receptor polymer capable of being dyed, and the resultant mixture is to be used for coating. By doing so, a receptor layer, in which the ultraviolet absorber is homogeneously dispersed, can be formed.

The addition amount of the ultraviolet-absorber-grafted polymer or its latex is preferably 5 to 50 parts by mass, more preferably 10 to 30 parts by mass, to 100 parts by mass of the latex of the receptor polymer capable of being dyed, which receptor polymer is to be utilized to ford the receptor layer.

The amount of the receptor layer to be applied is preferably 0.5 to 10 g/m$^2$ (solid basis, hereinafter, the amount to be applied in the present specification means a value on solid basis, unless otherwise specified), more preferably 1 to 8 g/m$^2$, and further preferably 2 to 7 g/m$^2$. The film thickness of the receptor layer is preferably 1 to 20 μm.

(Heat Insulation Layer)

A heat insulation layer serves to protect the support from heat when a thermal head or the like is used to carry out a transfer operation under heating. Also, because the heat insulation layer generally has proper cushion characteristics, a heat-sensitive transfer image-receiving sheet having high printing sensitivity can be obtained even in the case of using paper as a support. The heat insulation layer may be a single layer, or multi-layers. The heat insulation layer is generally arranged at a nearer location to the support than the receptor layer.

In the image-receiving sheet of the present invention, the heat insulation layer contains hollow polymer particles.

The hollow polymer particles in the present invention are polymer particles having independent pores inside of the particles. Examples of the hollow polymer particles include (1) non-foaming type hollow particles obtained in the following manner: a dispersion medium, such as water, is contained inside of a capsule wall formed of a polystyrene, acryl resin, or styrene/acryl resin, and, after a coating solution is applied and dried, the dispersion medium in the particles is vaporized out of the particles, with the result that the inside of each particle forms a hollow; (2) foaming type microballoons obtained in the following manner: a low-boiling point liquid, such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling point liquid inside of the particles, whereby the inside of each particle is made to be hollow; and (3) microballoons obtained by foaming the above (2) under heating in advance, to make hollow polymer particles.

The particle size of the hollow polymer particles is preferably 0.1 to 20 μm, more preferably 0.1 to 2 μm, further preferably 0.1 to 1 μm, particularly preferably 0.2 to 0.8 μm. It is because an excessively small size may lead to decrease of the void ratio (hollow ratio) of the particles, prohibiting desirable heat-insulating property, while an excessively large size in relation to the film thickness of the heat insulation layer may result in problems in preparation of smooth surface and cause coating troubles due to the coarse or bulky particles.

The hollow ratio (percentage of hollowness) of the hollow polymer particles is preferably in the range of from about 20% to about 70%, and more preferably from 20% to 50%. If the hollow ratio is too small, it becomes difficult to obtain sufficient heat-insulating property. In contrast, if the hollow ratio is excessively higher, a proportion (rate) of incomplete hollow particles increases in the aforementioned preferable range of the particle size, so that it becomes difficult to obtain sufficient film strength.

In the present invention, the hollow ratio (%) of hollow polymer particles is determined by taking a transmission electron microscope photograph of at least 300 hollow polymer particles, measuring the circle-equivalent diameter of the void (hollow) in each particle and the diameter of the hollow polymer particle, calculating individual hollow ratio (%) from the measured values according to the following formula, and averaging the individual hollow ratios:

$$\text{Individual hollow ratio (\%)} = (\text{Circle-equivalent diameter of void})^3/(\text{Diameter of hollow polymer particle})^3 \times 100$$

Herein, the "circle-equivalent diameter of the void" means a diameter of a circle having an area equal to that of an individual void measured.

The glass transition temperature (Tg) of the hollow polymer particles is preferably 70° C. or higher, more preferably 100° C. or higher. These hollow polymer particles may be used in combinations of two or more of those, according to the need.

Such hollow polymer particles are commercially available. Specific examples of the above (1) include Rohpake 1055, manufactured by Rohm and Haas Co.; Boncoat PP-1000, manufactured by Dainippon Ink and Chemicals, Incorporated; SX866(B), manufactured by JSR Corporation; and Nippol MH5055, manufactured by Nippon Zeon (all of these product names are trade names). Specific examples of the above (2) include F-30, and F-50, manufactured by Matsumoto Yushi-Seiyaku Co., Ltd. (all of these product names are trade names). Specific examples of the above (3) include F-30E, manufactured by Matsumoto Yushi-Seiyaku Co., Ltd, and Expancel 461DE, 551DE, and 551DE20, manufactured by Nippon Ferrite (all of these product names are trade names). Among these, the hollow polymer particles of the above (1) may be preferably used.

In the heat insulation layer containing the hollow polymer particles, a water-dispersible-type resin or water-soluble-type resin is preferably added, as a binder (binder resin). As the binder resin that can be used in the present invention, use may be made of a known resin, such as an acryl resin, a styrene/acryl copolymer, a polystyrene resin, a polyvinyl alcohol resin, a vinyl acetate resin, an ethylene/vinyl acetate copolymer, a vinyl chloride/vinyl acetate copolymer, a styrene/butadiene copolymer, a polyvinylidene chloride resin, a cellulose derivative, casein, starch, and gelatin. Also, these resins may be used either singly or as a mixture thereof.

The solid content of the hollow polymer particles in the heat insulation layer preferably falls in a range from 5 to 2,000 parts by mass, more preferably 5 to 1,000 parts by mass, and further preferably 5 to 400 parts by mass, assuming that the solid content of the binder resin be 100 parts by mass. Also, the ratio by mass of the solid content of the hollow polymer particles in the coating solution is preferably 1 to 70% by mass and more preferably 10 to 40% by mass. If the ratio of the hollow polymer particles is excessively low, sufficient heat insulation cannot be obtained, whereas if the ratio of the hollow polymer particles is excessively large, the adhesion between the hollow polymer particles is reduced, and thereby sufficient film strength cannot be obtained, causing deterioration in abrasion resistance.

The heat insulation layer of the heat-sensitive transfer image-receiving sheet of the present invention is preferably free of any resins that are not resistant to an organic solvent, except for the hollow polymer particles. Incorporation of the resin that is not resistant to an organic solvent (a resin having a dye-dyeing affinity) in the heat insulation layer is not preferable, in view of increase in loss of image definition after image transfer. It is assumed that the color-edge definition loss increases by the reason that owing to the presence of both the resin having a dye-dyeing affinity and the hollow polymer particles in the heat insulation layer, a transferred dye that has dyed the receptor layer migrates through the heat insulation layer adjacent thereto with the lapse of time.

Herein, the term "the resin that is not resistant to an organic solvent" means a resin having a solubility in an organic solvent (e.g., methyl ethyl ketone, ethyl acetate, benzene, toluene, xylene) of generally 0.5 mass % or more, preferably 1 mass % or more. For example, the above-mentioned latex polymer is included in the category of "the resin that is not resistant to an organic solvent".

Further, it is preferable to add the aforementioned water-soluble polymer to the heat-insulating layer. Preferable compounds that can be used as the water-soluble polymer in the heat-insulation layer are the same as those mentioned above, which are enumerated as examples to be added in the receptor layer.

The amount of the water-soluble polymer to be added in the heat insulation layer is preferably from 1 to 75 mass %, more preferably from 1 to 50 mass %, to the entire heat insulation layer.

The heat insulation layer preferably contains a gelatin. The amount of the gelatin in the coating solution for the heat insulation layer is preferably 0.5 to 14% by mass, and particularly preferably 1 to 6% by mass. Also, the coating amount of the above hollow polymer particles in the heat insulation layer is preferably 1 to 100 g/m$^2$, and more preferably 5 to 20 g/m$^2$.

The water-soluble polymer that is contained in the heat insulation layer has been preferably cross-linked with the crosslinking agent. Preferable compounds as well as a preferable amount of the crosslinking agent to be used are the same as mentioned above.

A preferred ratio of a cross-linked water-soluble polymer in the heat insulation layer varies depending on the kind of the crosslinking agent, but the water-soluble polymer in the heat insulation layer is crosslinked by preferably 0.1 to 20 mass %, more preferably 1 to 10 mass %, based on the entire water-soluble polymer.

A thickness of the heat insulation layer containing the hollow polymer particles is preferably from 5 to 50 μm, more preferably from 5 to 40 μm.

A void ratio (porosity ratio) of the heat insulation layer, which is calculated from the thickness of the heat insulation layer containing hollow polymer particles and the solid-matter coating amount of the heat insulation layer including the hollow polymer particles, is preferably 10 to 70% and more preferably 15 to 60%. When the void ratio for the heat-insulation layer is too low, sufficient heat insulation property cannot be obtained. When the void ratio is too large, the binding force among hollow polymer particles deteriorates, and thus sufficient film strength cannot be obtained, and abrasion resistance deteriorates.

The void ratio of the heat insulation layer as referred to herein is a value V calculated according to formula (b) below.

$$V=1-L/L\times\Sigma gi-di \qquad \text{Formula (b)}$$

In formula (b), L represents the thickness of the heat-insulating layer; gi represents the coating amount of a particular material i in terms of solid matter for the heat-insulating layer; and di represents the specific density of the particular material i. When di represents the specific density of the hollow polymer particles, di is the specific density of the wall material of hollow polymer particles.

(Undercoat Layer)

An undercoat layer may be formed between the receptor layer and the heat insulation layer. As the undercoat layer, for example, at least one of a white background controlling layer, a charge-controlling layer, an adhesive layer, and a primer layer is formed. These layers may be formed in the same manner as those described in, for example, each specification of Japanese Patent Nos. 3585599 and 2925244.

(Support)

As the support, use may be made of any kind of hitherto known supports, and no limitation is imposed thereto, but it is preferred in the present invention to use a water-proof support. The use of the waterproof support makes it possible to prevent the support from absorbing moisture, whereby a fluctuation in the performance of the receptor layer with the lapse of time can be prevented. As the waterproof Support, for example, coated paper or laminate paper may be used.

—Coated Paper—

The coated paper is paper obtained by coating a sheet, such as base paper, with any of various resins, rubber latexes, or high-molecular materials, on one side or both sides of the sheet, in which the coating amount differs depending on its use. Examples of such coated paper include art paper, cast coated paper, and Yankee paper.

It is preferable to use a thermoplastic resin as the resin to be applied to the surface(s) of the base paper and the like. As such a thermoplastic resin, the following thermoplastic resins (A) to (H) may be exemplified.

(A) Polyolefin resins, such as polyethylene resin and polypropylene resin; copolymer resins composed of an olefin, such as ethylene or propylene, and another vinyl monomer; and acrylic resins.

(B) Thermoplastic resins having an ester linkage: for example, polyester resins obtained by condensation of a dicarboxylic acid component (such a dicarboxylic acid component may be substituted with a sulfonic acid group, a carboxyl group, or the like) and an alcohol component (such an alcohol component may be substituted with a hydroxyl group, or the like); polyacrylate resins or polymethacrylate resins, such as polymethyl methacrylate, polybutyl methacrylate, polymethyl acrylate, polybutyl acrylate, or the like; polycarbonate resins, polyvinyl acetate resins, styrene acrylate resins, styrene/methacrylate copolymer resins, vinyltoluene acrylate resins, or the like.

Concrete examples of them are those described in JP-A-59-101395, JP-A-63-7971, JP-A-63-7972, JP-A-63-7973, and JP-A-60-294862.

Commercially available thermoplastic resins usable herein are, for example, Vylon 290, Vylon 200, Vylon 280, Vylon 300, Vylon 103, Vylon GK-140, and Vylon GK-130 (products of Toyobo Co., Ltd.); Tafton NE-382, Tafton U-5, ATR-2009, and ATR-2010 (products of Kao Corporation); Elitel UE 3500, UE 3210, XA-8153, KZA-7049, and KZA-1449 (products of Unitika Ltd.); and Polyester TP-220, and R-188 (products of The Nippon Synthetic Chemical Industry Co., Ltd.); and thermoplastic resins in the Hyros series from Seiko Chemical Industries Co., Ltd., and the like (all of these names are trade names).

(C) Polyurethane resins, etc.

(D) Polyamide resins, urea resins, etc.

(E) Polysulfone resins, etc.

(F) Polyvinyl chloride resins, polyvinylidene chloride resins, vinyl chloride/vinyl acetate copolymer resins, vinyl chloride/vinyl propionate copolymer resins, etc.

(G) Polyol resins, such as polyvinyl butyral; and cellulose resins, such as ethyl cellulose resin and cellulose acetate resin.

(H) Polycaprolactone resins, styrene/maleic anhydride resins, polyacrylonitrile resins, polyether resins, epoxy resins, and phenolic resins.

The thermoplastic resins may be used either singly or in combination of two or more of those.

The thermoplastic resin may contain or may have contained a whitener, a conductive agent, a filler, a pigment or dye including, for example, titanium oxide, ultramarine blue, and carbon black; or the like, if necessary.

—Laminated Paper—

The laminated paper is a paper which is formed by laminating any of various kinds of resins, rubbers, polymer sheets or films, on a sheet, such as a base paper or the like. Specific examples of the materials useable for the lamination include polyolefins, polyvinyl chlorides, polyethylene terephthalates, polystyrenes, polymethacrylates, polycarbonates, polyimides, and triacetylcelluloses. These resins may be used either singly or in combination of two or more of those.

Generally, the polyolefins are prepared by using a low-density polyethylene, in many cases. In the present invention, however, for improving the thermal resistance of the support, it is preferred to use a polypropylene, a blend of a polypropylene and a polyethylene, a high-density polyethylene, or a blend of a high-density polyethylene and a low-density polyethylene. From the viewpoint of cost and its suitableness for the lamination, it is particularly preferred to use the blend of a high-density polyethylene and a low-density polyethylene.

The blend of a high-density polyethylene and a low-density polyethylene is used in a blend ratio (a mass ratio) of generally 1/9 to 9/1, preferably 2/8 to 8/2, and more preferably 3/7 to 7/3. When the thermoplastic resin layer is formed on each surface of the support, the back side of the support is preferably formed using, for example, the high-density polyethylene, or the blend of a high-density polyethylene and a low-density polyethylene. The molecular mass of the polyethylenes is not particularly limited. Preferably, the high-density polyethylene and the low-density polyethylene each have a melt index of 1.0 to 40 g/10-min and a high extrudability.

The sheet or film may be subjected to a treatment to impart white reflection thereto. As a method of such a treatment, for example, a method of incorporating a pigment, such as titanium oxide, into the sheet or film, can be mentioned.

The thickness of the support is preferably from 25 μm to 300 μm, more preferably from 50 μm to 260 μm, and further preferably from 75 μm to 220 μm. The support can have any rigidity according to the purpose. When it is used as a support for electrophotographic image-receiving sheet of photographic image quality, the rigidity thereof is preferably near to that in a support for use in color silver halide photography.

(Curling-Control Layer)

When the support is exposed as it is, there is the case where the heat-sensitive transfer image-receiving sheet is made to curl by moisture and/or temperature in the environment. It is therefore preferable to form a curling-control layer on the backside of the support. The curling-control layer not only prevents the image-receiving sheet from curling but also has a water-proof function. For the curling-control layer, a polyethylene laminate, a polypropylene laminate, or the like is used. Specifically, the curling-control layer may be formed in a manner similar to those described in, for example, JP-A-61-110135 and JP-A-6-202295.

(Writing Layer and Charge-Controlling Layer)

For the writing layer and the charge-control layer, an inorganic oxide colloid, an ionic polymer, or the like may be used. As the antistatic agent, use may be made of any antistatic agents including cationic antistatic agents, such as a quaternary ammonium salt and polyamine derivative, anionic antistatic agents, such as alkyl phosphate, and nonionic antistatic agents, such as fatty acid ester. Specifically, the writing layer and the charge-control layer may be formed in a manner similar to those described in the specification of Japanese Patent No. 3585585.

The method of producing the heat-sensitive transfer image-receiving sheet of the present invention is explained below.

The heat-sensitive transfer image-receiving sheet of the present invention can be preferably formed, by applying at least one receptor layer, at least one intermediate layer, and at least one heat-insulating layer, on a support, through simultaneous multi-layer coating.

It is known that in the case of producing an image-receiving sheet composed of plural layers having different functions from each other (for example, an air cell layer, a heat insulation layer, an intermediate layer, and a receptor layer) on a support, it may be produced by applying each layer successively one by one, or by overlapping the layers each already coated on a support, as shown in, for example, JP-A-2004-106283, JP-A-2004-181888 and JP-A-2004-345267. It has been known in photographic industries, on the other hand, that productivity can be greatly improved, for example, by providing plural layers through simultaneous multi-layer coating. For example, there are known methods, such as the so-called slide coating (slide coating method) and curtain coating (curtain coating method), as described in, for example, U.S. Pat. Nos. 2,761,791, 2,681,234, 3,508,947, 4,457,256 and 3,993,019; JP-A-63-54975, JP-A-61-278848, JP-A-55-86557, JP-A-52-31727, JP-A-55-142565, JP-A-50-43140, JP-A-63-80872, JP-A-54-54020, JP-A-5-104061, JP-A-5-127305, and JP-B-49-7050; and Edgar B. Gutoff, et al., "Coating and Drying Defects: Troubleshooting Operating Problems", John Wiley & Sons, 1995, pp. 101-103; and "LIQUID FILM COATING", CHAPMAN & HALL, 1997, pp. 401-536.

In the present invention, the productivity is greatly improved and, at the same time, image defects can be remarkably reduced, by using the above simultaneous multilayer coating for the production of an image-receiving sheet having a multilayer structure. Besides, more favorable stability of quality can be achieved by the above-described multilayer-coating in addition to the constitution of the heat-sensitive transfer image-receiving sheet according to the present invention.

The plural layers in the present invention are structured using resins as its major components. Coating solutions forming each layer are preferably water-dispersible latexes. The solid content by mass of the resin put in a latex state in each layer coating solution is preferably in the range from 5 to 80% and particularly preferably 20 to 60%. The average particle size of the resin contained in the above water-dispersed latex is preferably 5 μm or less and particularly preferably 1 μm or less. The above water-dispersed latex may contain a known additive, such as a surfactant, a dispersant, and a binder resin, according to the need.

In the present invention, it is preferred that a laminate composed of plural layers be formed on a support and solidified just after the forming, according to the method described in U.S. Pat. No. 2,761,791. For example, in the case of solidifying a multilayer structure by using a resin, it is preferable to raise the temperature immediately after the plural layers are formed on the support. Also, in the case where a binder (e.g., gelatin) to be gelled at lower temperatures is contained, there is the case where it is preferable to drop the temperature immediately after the plural layers are formed on the support.

In the present invention, the coating amount of a coating solution per one layer constituting the multilayer structure is preferably in the range from 1 g/m$^2$ to 500 g/m$^2$. The number of layers in the multilayer structure may be arbitrarily selected from a number of 2 or more. The receptor layer is preferably provided as a layer most apart from the support.

A heat-sensitive transfer sheet (an ink sheet) that is used in combination with the heat-sensitive transfer image-receiving sheet of the present invention as mentioned above, at the time of formation of a heat transfer image, is, for example, a sheet having on a support a dye layer containing a diffusion-transfer dye, and any ink sheet can be used as the sheet. As a means for providing heat energy in the thermal transfer, any of the known providing means may be used. For example, application of a heat energy of about 5 to 100 mJ/mm$^2$ by controlling the recording time in a recording device, such as a thermal printer (e.g., trade name: Video Printer VY-100, manufactured by Hitachi, Ltd.), sufficiently attains the expected result.

Also, the heat-sensitive transfer image-receiving sheet of the present invention may be used in various applications enabling thermal transfer recording, such as heat-sensitive transfer image-receiving sheets in a form of thin sheets (cut sheets) or rolls; cards; and transmittable-type manuscript-making sheets, by appropriately selecting the type of support.

The present invention can be applied to a printer, a copying machine, and the like, each of which uses a heat-sensitive transfer recording system.

According to the present invention, image defects due to heat seal with an ink sheet can be remarkably reduced, as compared to the conventional technique. Thus, the present invention can provide the heat-sensitive transfer image-receiving sheet giving an excellent image, and also provide a production method of the image-receiving sheet.

The present invention will be described in more detail based on the following examples, but the invention is not intended to be limited thereto. In the following examples, the terms "part(s)" and "%" are values by mass, unless otherwise specified.

EXAMPLES

Reference Example 1

Preparation of Ink Sheet

A polyester film 6.0 μm in thickness (trade name: Lumirror, manufactured by Toray Industries, Inc.) was used as the substrate film. A heat-resistant slip layer (thickness: 1 μm) was formed on the back side of the film, and the following yellow, magenta, and cyan compositions were respectively applied as a monochromatic layer (coating amount: 1 g/m$^2$ after drying) on the front side of the film.

| Yellow composition | |
|---|---|
| Yellow dye (trade name: Macrolex Yellow 6G, manufactured by Bayer) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |
| **Magenta composition** | |
| Magenta dye (trade name; Disperse Red 60) | 5.5 parts by mass |
| Polyvinylbutyral resin (trade name: KSLEC BX-1, manufactured by Sekisui Chemical Co., Ltd.) | 4.5 parts by mass |
| Methyl ethyl ketone/toluene (1/1, at mass ratio) | 90 parts by mass |
| **Cyan composition** | |
| Cyan dye (Solvent Blue 63) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |

Example 1

Preparation of Image-Receiving Sheet

(1) Preparation of Samples 101 to 109

(Preparation of Support)

A pulp slurry was prepared from 50 parts by mass of hardwood bleach kraft pulp (LBKP) of acacia origin and 50 parts by mass of hardwood bleach kraft pulp (LBKP) of aspen origin, by beating these pulps by means of a disk refiner until Canadian standard freeness reached to 300 ml.

Then, to the pulp slurry thus prepared were added, on a pulp basis, 1.3 mass % of cationically-modified starch (CAT0304L, trade name, manufactured by Nippon NSC), 0.15 mass % of anionic polyacrylamide (DA4104, trade name, manufactured by Seiko PMC Corporation), 0.29 mass % of an alkylketene dimer (SIZEPINE K, trade name, manufactured by Arakawa Chemical Industries, Ltd.), 0.29 mass % of epoxidated behenic acid amide, and 0.32 mass % of polyamide polyamine epichlorohydrin (ARAFIX 100, trade name, manufactured by Arakawa Chemical Industries, Ltd.), and thereafter 0.12 mass % of a defoaming agent was further added.

The thus-prepared pulp slurry was made into paper by use of a fourdrinier paper machine. In a process of drying in which the felt side of web was pressed against a drum dryer cylinder via a dryer canvas, the web thus formed was dried under the condition that the tensile strength of the dryer canvas was adjusted to 1.6 kg/cm. Then, each side of the raw paper thus made was coated with 1 g/m$^2$ of polyvinyl alcohol (KL-118, trade name, manufactured by Kuraray Co., Ltd.) with a size press, followed by drying and further subjecting to calendering treatment. The papermaking was performed so that the raw paper had a grammage (basis weight) of 157 g/m$^2$, and the raw paper (base paper) of thickness 160 μm was obtained.

The wire side (back side) of the base paper obtained was subjected to corona discharge treatment, and thereto a resin composition, in which a high-density polyethylene of MFR (which stands for a melt flow rate, and hereinafter has the same meaning) 16.0 g/10-min and density 0.96 g/cm$^3$ (containing 250 ppm of hydrotalcite (DHT-4A (trade name), manufactured by Kyowa Chemical Industry Co., Ltd.) and 200 ppm of a secondary oxidation inhibitor (tris(2,4-di-t-butylphenyl)phosphite, Irugaphos 168 (trade name), manufactured by Ciba Specialty Chemicals)) and a low-density polyethylene of MFR 4.0 g/10-min and density 0.93 g/cm$^3$ were mixed at a ratio of 75 to 25 by mass, was applied so as to have a thickness of 21 g/m$^2$, by means of a melt extruder, thereby forming a thermoplastic resin layer with a mat surface. (The side to which this thermoplastic resin layer was provided is hereinafter referred to as "back side"). The thermoplastic resin layer at the back side was further subjected to corona discharge treatment, and then coated with a dispersion prepared by dispersing into water a 1:2 mixture (by mass) of aluminum oxide (ALUMINASOL 100, trade name, manufactured by Nissan Chemical Industries, Ltd.) and silicon dioxide (SNOWTEX O, trade name, manufactured by Nissan Chemical Industries, Ltd.), as an antistatic agent, so that the coating would have a dry mass of 0.2 g/m$^2$. Then, the front surface (front side) of the base paper was subjected to corona discharge treatment, and then coated with a low-density polyethylene of MFR 4.0 g/10-min and density 0.93 g/m$^2$, containing 10 mass % of titanium oxide, by means of a melt extruder, so that the coating amount would be 27 g/m$^2$, thereby forming a thermoplastic resin layer with a specular surface.

(Preparation of Emulsified Dispersion A)

An emulsified dispersion A was prepared in the following manner. An antioxidant (EB-9) was dissolved in a mixture of 42 g of a high-boiling solvent (Solv-5) and 20 ml of ethyl acetate, and the resultant solution was emulsified and dispersed in 250 g of a 20-mass % aqueous gelatin solution containing 1 g of sodium dodecylbenzenesulfonate, by means of a high-speed stirring emulsifier (dissolver). Thereto, water was added, to prepare 380 g of the emulsified dispersion A.

The addition amount of the antioxidant (EB-9) was adjusted so that the compound would be contained in an amount of 30 mol % in the emulsified dispersion A.

(Preparation of Releasing Agent Emulsified Dispersion B)

To 1.0 kg of the releasing agent (L1-101) according to the present invention, were added 2.4 L of water, 30 ml of phenoxyethanol, 10 g of methyl p-hydroxybenzoate, and 1.0 kg of gelatin, to admix the resultant mixture, under stirring at 50° C. for 20 minutes. To the resultant mixture, 250 ml of a 10-mass % aqueous solution of sodium oleoylmethyltaurine was added, followed by stirring for 60 min at 5,000 rpm with dissolver, thereby to prepare an emulsified dispersion. To the thus-obtained emulsified dispersion, water of 40° C. was added, to make 10 kg of the final amount. An average particle size of the thus-obtained emulsified dispersion was measured using a particle size measuring apparatus by light scattering method, LA-920 (trade name, manufactured by HORIBA), and the average particle size was 0.22 μm.

Then, emulsified dispersions were prepared in the same manner as the aforementioned Releasing agent emulsified dispersion B, except that the releasing agent L1-101 used for the preparation of the Releasing agent emulsified dispersion B was replaced by an equivalent mass amount of a compound, as shown in Table 2 set forth in the below, respectively. The average particle size of each of the thus-obtained emulsified dispersions was 0.23 μm.

Releasing agents that was used for comparison are shown below.

| | |
|---|---|
| Compound for comparison-1 | |
| $C_{15}H_{31}COOC_{14}H_{29}$ | Molecular mass: 452 |
| Compound for comparison-2 | |
| Microcrystalline wax (Hi-Mic-1045 (trade name), manufactured by Nippon Seiro Co., Ltd.) | Average molecular mass: ca. 500 |
| Compound for comparison-3 | |
| RCOO—($C_2H_4$)n—OCOR<br>R = an alkyl group having 28 to 32 carbon atom, n = 1 to 4 | Average molecular mass: ca. 850 |
| Compound for comparison-4 | |
| RCOOH<br>R = an alkyl group having 28 to 32 carbon atom | Average molecular mass: ca. 450 |

Samples 101 to 109 were prepared by coating, on the support which was already prepared in the foregoing manner, to form a multilayer structure having a subbing layer 1, a subbing layer 2, a heat insulation layer, and a receptor layer, in increasing order of distance from the support. These layers were provided by coating, according to a simultaneous multilayer coating method.

The compositions and coated amounts of the coating solutions to be used are shown below.

The simultaneous multi-layer coating was carried out, according to the slide coating method described in the aforementioned "LIQUID FILM COATING" p. 427; and after coating, the thus-coated products were passed through a set zone at 6° C. for 30 seconds to lose fluidity, followed by drying by spraying a drying air at 22° C. and 45% RH on the coated surface for 2 minutes.

| | |
|---|---|
| Coating solution for subbing layer 1 (Composition)<br>Aqueous solution, prepared by adding 1% of sodium dodecylbenzenesulfonate to a 3% aqueous gelatin solution<br>NaOH for adjusting pH to 8<br>(Coating amount) | 11 ml/m$^2$ |
| Coaling solution for subbing layer 2 (Composition) | |
| Styrene-butadiene latex (SR103 (trade name), manufactured by Nippon A & L Inc.) | 60 parts by mass |
| 6% Aqueous solution of polyvinyl alcohol (PVA) | 40 parts by mass |
| NaOH for adjusting pH to 8<br>(Coating amount) | 11 ml/m$^2$ |
| Coating solution for heat insulation layer (Composition) | |
| Hollow latex polymer particles (MH5055 (trade name), manufactured by Nippon Zeon Corporation) | 60 parts by mass |
| 10% Gelatin aqueous solution | 20 parts by mass |
| Emulsified dispersion A prepared in the above | 20 parts by mass |
| NaOH for adjusting pH to 8<br>(Coating amount) | 45 ml/m$^2$ |
| Coating solution for receptor layer 1 (Composition) | |
| Vinyl chloride-latex polymer (VINYBLAN 900 (trade name), manufactured by Nissin Chemical Industry Co., Ltd.) | 85 parts by mass |
| Vinyl chloridc-latex polymer (VINYBLAN 276 (trade name), manufactured by Nissin Chemical Industry Co., Ltd.) | 50 parts by mass |
| Releasing agent emulsified dispersion B | 20 parts by mass |
| Water | 14 parts by mass |
| NaOH for adjusting pH to 8<br>(Coating amount) | 18 ml/m$^2$ |

(Image Formation and Evaluation)

The ink sheet and any one of the Samples 101 to 109 of the image-receiving sheets were processed so that they would be mounted in a sublimation-type printer ASK2000 (trade name, a product of FUJIFILM Corporation). Then, an image was outputted under the setting conditions necessary to obtain a gray gradation entirely ranging from the minimum density to the maximum density in a high speed print mode. In this test, it took 8 sec to output a sheet of L-size print.

The transferring property of the dye was evaluated in terms of the density of the thus-obtained image transferred (herein referred to as a transferred density).

The releasing property of the image-receiving sheet from the ink sheet was evaluated in terms of stripe-like unevenness (sticking), by observation on the surface of the solid image with the maximum density output according to the above-described method. The values of Dmax are also shown together with the evaluation of sticking. The results with the following evaluation rank are shown in Table 2.

Evaluation Rank

5: No sticking was observed, and there was no problem.

4: Sticking was found with the naked eye but in a slight degree, and there was no problem in practice.

3: Sticking was found with the naked eye, and a problem was arisen in practice in some cases.

2: Although a print was delivered out, the resultant print was not proper in practice due to a serious problem on the image.

1: No print was delivered out, which was a problem.

TABLE 2

| Sample No. | Releasing agent | Transferred density | Sticking | Remarks |
|---|---|---|---|---|
| 101 | L1-101 | 2.28 | 5 | This invention |
| 102 | L1-102 | 2.26 | 5 | This invention |
| 103 | L1-105 | 2.24 | 4 | This invention |
| 104 | L1-115 | 2.27 | 5 | This invention |
| 105 | L1-118 | 2.25 | 4 | This invention |
| 106 | Compound for comparison-1 | 2.10 | 2 | Comparative example |
| 107 | Compound for comparison-2 | 2.20 | 3 | Comparative example |
| 108 | Compound for comparison-3 | 2.28 | 2 | Comparative example |
| 109 | Compound for comparison-4 | 2.25 | 3 | Comparative example |

Example 2

(2) Preparation of Samples 201 to 205

Samples 201 to 205 were prepared in the same manner as in the Example 1, except that the coating solution for receptor layer 1 was replaced by a coating solution for receptor layer 2 as set forth in the below. Releasing agents to be used are shown in Table 3.

| Coating solution for receptor layer 2 (Composition) | |
|---|---|
| Vinyl chloride-latex polymer (VINYBLAN 900 (trade name), manufactured by Nissin Chemical Industry Co., Ltd.) | 85 parts by mass |
| Vinyl chloride-latex polymer (VINYBLAN 276 (trade name), manufactured by Nissin Chemical Industry Co., Ltd.) | 50 parts by mass |
| Releasing agent emulsified dispersion B | 20 parts by mass |
| Emulsified dispersion A prepared in the above | 10 parts by mass |
| Water | 15 parts by mass |
| NaOH for adjusting pH to 8 | 18 ml/m$^2$ |
| (Coating amount) | |

Image Formation and Evaluation

By combining the ink sheet and any one of the Samples 201 to 205 of the image-receiving sheets, evaluation was performed in the same manner as in Example 1. The results of evaluation are shown in Table 3.

TABLE 3

| Sample No. | Releasing agent | Transferred density | Sticking | Remarks |
|---|---|---|---|---|
| 201 | L1-101 | 2.24 | 5 | This invention |
| 202 | L1-105 | 2.23 | 4 | This invention |
| 203 | L1-115 | 2.23 | 5 | This invention |
| 204 | Compound for comparison-2 | 2.30 | 2 | Comparative example |
| 205 | Compound for comparison-3 | 2.06 | 3 | Comparative example |

Example 3

(3) Preparation of Samples 301 to 304

Samples 301 to 304 were prepared in the same manner as in the Example 1, except that the coating solution for receptor layer 1 was replaced by a coating solution for receptor layer 3 as set forth in the below. Releasing agents to be used are shown in Table 4.

| Coating solution for receptor layer 3 (Composition) | |
|---|---|
| Vinyl chloride-latex polymer (VINYBLAN 900 (trade name), manufactured by Nissin Chemical Industry Co., Ltd.) | 85 parts by mass |
| Vinyl chloride-latex polymer (VINYBLAN 276 (trade name), manufactured by Nissin Chemical Industry Co., Ltd.) | 50 parts by mass |
| 10% Gelatin aqueous solution | 10 parts by mass |
| Releasing agent emulsified dispersion B | 20 parts by mass |
| Emulsified dispersion A prepared in the above | 10 parts by mass |
| Water | 5 parts by mass |
| Compound X (crosslinking agent) | 1 parts by mass |
| NaOH for adjusting pH to 8 | 18 ml/m$^2$ |
| (Coating amount) | |

Compound X

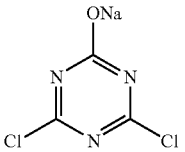

Image Formation and Evaluation

By combining the ink sheet and any one of the Samples 301 to 304 of the image-receiving sheets, evaluation was performed in the same manner as in Example 1. The results of evaluation are shown in Table 4.

TABLE 4

| Sample No. | Releasing agent | Transferred density | Sticking | Remarks |
|---|---|---|---|---|
| 301 | L1-101 | 2.22 | 5 | This invention |
| 302 | L1-109 | 2.23 | 4 | This invention |
| 303 | Compound for comparison-1 | 2.25 | 3 | Comparative example |
| 304 | Compound for comparison-3 | 2.03 | 3 | Comparative example |

As described and demonstrated in the above, according to the heat-sensitive transfer image-receiving sheet of the present invention, it is possible to drastically reduce image defects due to heat seal with an ink sheet, as compared to the conventional heat-sensitive transfer image-receiving sheet. Thus, according to the present invention, the heat-sensitive transfer image-receiving sheet, which can give an excellent image, can be provided; and also the method of producing the heat-sensitive transfer image-receiving sheet can be provided.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2006-269766 filed in Japan on Sep. 29, 2006, which is entirely herein incorporated by reference.

What we claim is:

1. A heat-sensitive transfer image-receiving sheet, having a substrate, and a dye receptor layer provided at least one side of the substrate, wherein the heat-sensitive transfer image-receiving sheet comprises at least one compound represented by formula (L1):

Formula (L1)

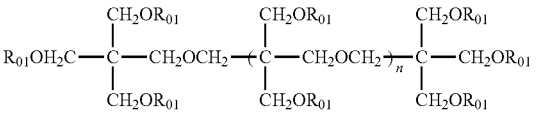

wherein $R_{01}$ represents —C(═O)R or a hydrogen atom, in which R represents an aliphatic group which may have a substituent, and a plurality of $R_{01}$'s are the same as or different from each other, but at least one of $R_{01}$'s is —C(═O)R; and n represents 0 or 1.

2. The heat-sensitive transfer image-receiving sheet according to claim 1, wherein the compound represented by formula (L1) is contained in the receptor layer.

3. The heat-sensitive transfer image-receiving sheet according to claim 1, wherein the receptor layer contains a latex polymer.

4. The heat-sensitive transfer image-receiving sheet according to claim 3, wherein the latex polymer in the receptor layer is composed of a copolymer having a repeating unit derived from vinyl chloride.

5. The heat-sensitive transfer image-receiving sheet according to claim 1, wherein the heat-sensitive transfer image-receiving sheet has a heat-insulating layer.

6. The heat-sensitive transfer image-receiving sheet according to claim 5, wherein the heat-insulating layer comprises hollow latex polymer particles.

7. The heat-sensitive transfer image-receiving sheet according to claim 1, wherein at least one of the receptor layer and the heat-insulating layer contains a water-soluble polymer.

8. The heat-sensitive transfer image-receiving sheet according to claim 7, wherein the at least one of the receptor layer and the heat-insulating layer containing the water-soluble polymer contains a compound capable of crosslinking the water-soluble polymer, and the water-soluble polymer is partially or wholly crosslinked.

9. A method of producing the heat-sensitive transfer image-receiving sheet according to claim 1, which comprises a production step of: simultaneously multilayer-coating the substrate with each of coating solutions of the dye receptor layer and a layer or layers adjacent thereto.

10. The method of producing the heat-sensitive transfer image-receiving sheet according to claim 9, wherein layers provided by the simultaneously multilayer-coating step are those including the receptor layer and a heat-insulating layer provided between the receptor layer and the substrate.

* * * * *